US006325497B1

(12) United States Patent
Takata

(10) Patent No.: US 6,325,497 B1
(45) Date of Patent: Dec. 4, 2001

(54) INK-JET PRINT HEAD

(75) Inventor: Masayuki Takata, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/704,662

(22) Filed: Nov. 3, 2000

Related U.S. Application Data

(62) Division of application No. 09/048,338, filed on Mar. 26, 1998, now Pat. No. 6,168,265.

(30) Foreign Application Priority Data

Mar. 28, 1997 (JP) ..... 9-077258
Apr. 23, 1997 (JP) ..... 9-105534

(51) Int. Cl.[7] ..... B41J 2/175
(52) U.S. Cl. ..... 347/85
(58) Field of Search ..... 347/84, 85, 86, 347/87, 70, 71, 65

(56) References Cited

U.S. PATENT DOCUMENTS 4,420,764 12/1983 Okada ..... 347/40
5,455,615 10/1995 Burr et al. ..... 347/92
5,793,396 8/1998 Sasaki ..... 347/86

FOREIGN PATENT DOCUMENTS 0 519 403 A2 12/1992 (EP) .
0 695 638 A2 2/1996 (EP) .
0 739 735 A3 10/1996 (EP) .
57 156263 A 9/1982 (JP) .
58 005261 A 1/1983 (JP) .

*Primary Examiner*—N. Le
*Assistant Examiner*—Michael P. Nghiem
(74) *Attorney, Agent, or Firm*—Oliff & Berridge, PLC

(57) ABSTRACT

An actuator 14 is formed with a plurality of ejection channels 13 in two rows which are spaced apart from each other at a prescribed distance. A manifold 17 is joined with an inflow end surface of the actuator 14. The manifold 17 is formed with an ink supply channel 16 for supplying liquid ink from the ink cartridge to each of the ejection channels 13. The ink supply channel 16 is formed to extend along the rows of the ejection channels 13 to be opened over the inflow ends 13*i* of the ejection channels 13. The width of the ink supply channel 16, opened at the surface of the manifold 17 as connected to the actuator 14, is less than or equal to the distance between the outer side inner walls 51 and 51 of ejection channels 13 in the two rows.

6 Claims, 12 Drawing Sheets

INK-JET PRINT HEAD

This is a Division Continuation-in-Part of application Ser. No. 09/048,338 filed Mar. 26, 1998 now U.S. Pat. No. 6,168,265. The entire disclosure of the prior application is hereby incorporated by reference herein in its entirety.

BACKGROUND OF THE INVENTION

1. Field of the Invention

The present invention relates to an ink-jet print head provided in an ink-jet printing device for ejecting liquid ink from nozzles onto a recording paper in order to form desired images on the recording paper.

2. Description of the Related Art

Ink-jet type printing devices are well-known in the art for their relatively simple construction and their high-speed and high-quality printing capabilities. These ink-jet printing devices employ ink-jet print heads therein.

SUMMARY OF THE INVENTION

One conceivable example of the ink-jet print head includes an actuator for selectively ejecting liquid ink in droplets. The actuator is made from a piezoelectric ceramic material, and is designed to have upper and lower end surfaces. The actuator is formed with a plurality of ejection channels. Each ejection channel extends between the upper and lower end surfaces. Each ejection channel Is opened on the upper end surface to have an inflow end for receiving liquid ink flowing therein, and is opened also on the lower end surface to have an outflow end for flowing the liquid ink out of the ejection channel. The ejection channels are arranged in several (two, for example) rows. In each row, corresponding ejection channels are arranged in line. The two rows of the ejection channels are apart from each other with a predetermined distance.

A nozzle plate is attached to the lower end surface (outflow end surface) of the actuator. The nozzle plate is formed with a plurality of nozzle holes for ejecting liquid ink. The nozzle plate is attached to the actuator so that each nozzle hole is in fluid communication with an outflow end of a corresponding ejection channel.

A manifold is attached to the upper end surface (inflow end surface) of the actuator. The manifold is formed with an ink supply channel to supply liquid ink from an ink supply source (ink tank) to the ejection channels. The ink supply channel is opened at one surface of the manifold. The manifold is therefore attached to the actuator so that the opened ink supply channel Is in fluid communication with the inflow ends of the ejection channels.

The ink-jet print head with the above-described structure is disposed at a downward slant of about 45 degrees, for example, so that the nozzle plate faces slantedly downwardly and the manifold is located above the nozzle plate. The actuator to partially applied with electric fields, thereby being partially transformed. The transformation in the actuator causes changes in the volume of a desired ejection channel. When the volume of the ejection channel is decreased, the liquid ink in that channel is ejected slantedly downwardly from the nozzle holes and onto a printing paper. When the volume of the ejection channel is increased, ink from the ink supply source is introduced into the ejection channel via the ink supply channel.

Problems in ink ejection can, however, occur when air bubbles are formed and retained in the ink-jet print head or when drops of ink are deposited on the surface of the nozzle plate. To maintain good quality ink ejection, a purge device is provided on the ink-jet printing device to remove by suction liquid ink containing those air bubbles from the ink-jet print head.

It is conceivable to provide two types of ink-jet print heads. In the first type of ink-jet print head, the ink supply channel has a single ink supply path in the manifold. That is, the single ink supply path is formed to extend along the two channel rows, and is opened to communicate with the inflow ends of all the ejection channels. In the second type of ink-jet recording head, on the other hand, the ink supply channel is formed to have two ink supply paths. In this type of print head, each ink supply path is formed to extend along a corresponding channel row, and Is opened to communicate with the inflow ends of all the ejection channels in the corresponding channel row.

FIG. 1 shows a conceivable structure of the ink-jet print head of the first type, wherein a single ink supply channel (path) 116 is provided in the manifold 117 to supply ink to two rows of ink ejection channels 113.

More specifically, the ink-jet print head is constructed from the manifold 117, the actuator 114, and the nozzle plate 111. The actuator 114 has upper and lower end surfaces opposite to each other. The actuator 114 Is formed with a plurality of ejection channels 113. Each ejection channel 113 extends between the upper and lower end surfaces. The ejection channel 113 therefore is opened at the upper surface to define an inflow end **113*i* for receiving ink flowing to the ejection channel 113. The ejection channel 113 is opened also at the lower end surface to define an outflow end 113*o* for flowing Ink out of the ejection channel 113**.

The plurality of ejection channels 113 are arranged in two rows parallel to each other. The two rows of channels 113 and 113 are separated from each other by a predetermined amount of distance. Accordingly, the upper end surface of the actuator 113 includes: a central area 171 defined between the two rows of ejection channels 113; and a pair of outer side areas 170 which are separated from the central area 171 and which sandwich the central area 171 therebetween. Each outer side area 170 is defined outside of the corresponding row of ejection channels 113.

Each ejection channel 113 in each row is a hollow space defined between an outer side inner wall 151, which extends from an inner edge of a corresponding outer side area 170, and an inner side inner wall 150 which extends from an outer edge of the central area 171. A distance D is provided between the outer side inner walls 151 in the two rows of ejection channels 113.

The manifold 117 is connected to the upper end surface (inflow end surface) of the actuator 114. The single ink supply channel 116 is formed in the manifold 117, and is opened at the surface, where the manifold 117 is attached to the actuator 114. The manifold 117 is connected to the actuator 114 so that the ink supply channel 116 is in fluid communication with the inflow ends **113*i* of the ejection channels 113. As apparent from FIG. 1, the ink supply channel 116 is approximately arc-shaped. That is, the ink supply channel 116 is defined by an inner wall 216 which is curved into an approximately arc-shape. The ink supply channel 116 has a width W on the surface of the manifold 117 where the ink supply channel 116 Is opened. More specifically, the manifold 117 has a pair of outer side areas 259 on the surface where the manifold 117 is connected to the actuator 114. The opened end of the ink supply channel 116 is located between the pair of outer side areas 259. The width W, defined as a distance between inner edges of the two outer side areas 259, is larger than the distance D between the outer side inner walls 151 of the ejection channels 113** in the two rows.

The nozzle plate 111 is connected to the lower end surface (outflow end surface) of the actuator 114. The nozzle plate 111 is formed with a plurality of nozzle holes 112. The nozzle plate 111 is connected to the actuator 114 such that each of the outflow ends 113*o* leads to a corresponding nozzle hole 112. With the above-described structure, liquid ink supplied from an ink supply source (not shown) is introduced via the ink supply channel 116 into the inflow ends 113*i* of the ejection channels 113, and is ejected from the nozzle holes 112.

When the manifold 117 and the actuator 114 having the above-described structures are joined together, the outer side areas 259 of the manifold 117 are bonded to the outer side areas 170 of the actuator 114 with adhesive. Because the width W of the ink supply channel 116 is larger than the distance D between the outer side inner walls 150, a pair of margin portions 110 are provided on the pair of outer side areas 170. Each margin portion 110 extends along a corresponding row of ejection channels 113.

Because the width W is larger than the distance D, when connecting the manifold 117 and the actuator 114 together, even if there exists some positioning discrepancy between the manifold 117 and the-actuator 114, the two rows of ejection channels 113 will not be blocked by the outer side areas 259 of the manifold 117. The two rows of ejection channels 113 are sufficiently opened at their inflow ends 113*i* and are in fluid communication with the ink supply channel 116.

With the above-described structure, when liquid ink is initially introduced through the ink supply channel 116 to the ejection channels 113, liquid ink flows along the inner wall 216 of the ink supply channel 116 toward the inflow ends 113*i* of the ejection channels 113. The thus flowing ink forcibly collides against the upper surfaces of the margin portions 110 before entering the ejection channels 113. Accordingly, air bubbles are generated due to the collision of the ink against the margin portions 110. Air bubbles can be generated also from adhesive provided between the outer side areas 170 and the outer side areas 259. The generated air bubbles have a tendency to remain in the area of the margin portions 110. As the air bubbles continue to accumulate and grow at the margin portions 110, the air bubbles become capable of being easily drawn into the ejection channels 113. The air bubbles thus drawn into the ejection channel 113 will prevent ink from being ejected from the ejection channels 113.

FIG. 2 shows a conceivable structure of an ink-jet print head of the second type, wherein two ink supply paths 260 are provided in the manifold 117 to supply ink to two rows of ink ejection channels 113, respectively.

The actuator 114 is formed with two rows of ejection channels 113 in the same manner as in the ink-jet print head of FIG. 1. The manifold 117, connected to the upper end surface (inflow end surface) of the actuator 114, is formed with the two ink supply channels 260. The manifold 117 is connected to the upper end surface of the actuator 114 so that each ink supply channel 260 extends along a corresponding row of ejection channels 113 in fluid communication with the inflow ends 113*i* of the ejection channels 113. Each ink supply channel 260 has an arc-shaped cross-section as shown in FIG. 2. That is, the manifold 117 is formed with two inner walls 316 for defining the two ink supply channels 260. Each inner wall 316 is shaped to have the arc-shaped cross-section of the ink supply channel 260.

Similarly to the structure of FIG. 1, the nozzle plate 111 is connected to the lower end surface (outflow end surface) of the actuator 114.

With this structure, liquid ink supplied from an ink supply source (not shown) is introduced via the ink supply channels 260 into the inflow ends 113*i* of the ejection channels 113, and then is ejected from the ejection channels 113 through the nozzle holes 112.

Also in the structure of FIG. 2, air bubbles are generated and retained in the ink supply channels 260. As shown in FIG. 2, air bubbles B are retained on the surface of the inner walls 316 of the supply channels 260 due to buoyancy and the like. It is assumed that an air bubble B is initially generated in each ink supply channel 260 as indicated by a dotted line in the figure. After some time has elapsed, the air bubble B grows until reaching the size indicated by a solid line in that figure. At this time. the outer surface of the air bubble B has grown near the inflow end 113*i* of a corresponding ejection channel 113, narrowing an ink flow path between the ink supply channel 260 and the ejection channel 113, and increasing the flow rate of ink involved in ejection. As a result, the negative pressure applied to the outer surface of the air bubble B increases. As a result, the air bubble B can easily be drawn into the ejection channel 113. If the air bubble B is drawn into the ejection channel 113. the air bubble prevents ink from being ejected through the ejection channel 113, causing ejection problems such as printing imperfections.

When such ejection problems occur, the purge device can be used to purge the air bubbles from the ink supply channels 260 and the ejection channels 113. However, if it takes only a short period of time before the growing air bubble B obstructs the ink supply path, then the purge operation must be executed frequently. As a result, not only do the operations become more complicated, but also an increasing amount of ink is expended, decreasing the amount of ink available for actual printing.

In view of the foregoing, it is an object of the present invention to provide an improved ink-jet print head which is capable of suppressing generation and growth of air bubbles in the ink supply channel, thereby suppressing the ink ejection problems and maintaining high quality printing conditions for a longer period of time.

In order to attain the above and other objects, the present invention provides an ink-jet print head comprising: a manifold having an ink supply channel opened on its one surface; an actuator formed with a plurality of ejection channels in a plurality of rows, the actuator having first and second end surfaces opposite to each other, the plurality of ejection channels extending between the first and second end surfaces to open at both of the first and second end surfaces, the actuator being connected, at its first end surface, to the manifold so that the plurality of ejection channels are in fluid communication with the ink supply channel for receiving ink from the ink supply channel, the actuator selectively ejecting ink from the opened ends of the ejection channels at the second end surface; and means for providing an ink flow path to ensure that ink flows from the ink supply channel to the ejection channels.

The actuator may be formed with a plurality of outer side inner walls, the plurality of outer side inner walls being arranged in two rows, each outer side inner wall on one row being spaced from a corresponding outer side inner wall on the other row at a predetermined distance, each outer side inner wall on one row defining a corresponding ejection channel, the plurality of outer side inner walls extending between the first and second end surfaces, thereby allowing the plurality of ejection channels to extend between the first and second end surfaces, the manifold having the ink supply channel on its surface connected to the actuator, the ink supply channel extending along the two rows of ejection channels in fluid communication therewith. The ink flow path providing means may set a width of the ink supply channel, defined on the surface where the manifold is connected to the actuator, to be less than or equal to the distance between the plurality of outer side inner walls.

The ink flow path providing means may provide the ink flow path on the first end surface of the actuator for allowing ink to flow in a direction at which the ejection channel rows extend. The ink flow path providing means may provide the ink flow path to extend between the plurality of rows of ejection channels.

According to another aspect, the present invention provides an ink-jet print head comprising: an actuator formed with a plurality of outer side inner walls, the plurality of outer side inner walls being arranged in two rows, each outer side inner wall on-one row being spaced from a corresponding outer side inner wall on the other row at a predetermined distance, each outer side inner wall defining an ejection channel, the actuator having first and second end surfaces opposite to each other, the plurality of outer side inner walls extending between the first and second end surfaces, thereby allowing the plurality of ejection channels to be opened at both of the first and second end surfaces, the actuator selectively ejecting liquid ink from the opened ends of the ejection channels at the second end surface; and a manifold connected, at its one surface, to the first end surface of the actuator, the manifold having an ink supply channel opened on its surface connected to the actuator, the ink supply channel extending along the two rows of ejection channels in fluid communication therewith to supply liquid ink to the two rows of ejection channels, a width of the ink supply channel, defined on the surface where the manifold is connected to the actuator, being less than or equal to the predetermined distance.

According to further aspect, the present invention provides an ink-jet print head comprising: a manifold having an ink supply channel opened on its one surface; and an actuator formed with a plurality of ejection channels in a plurality of rows, the actuator having first and second end surfaces opposite to each other, each of the plurality of ejection channels extending between the first and second end surfaces to open at both of the first and second end surfaces, the actuator being connected, at its first end surface, to the manifold so that the plurality of ejection channels are in fluid communication with the ink supply channel to receive ink from the ink supply channel, the actuator being formed with an ink flow path on its first end surface for allowing ink to flow in a direction at which the ejection channel rows extend, the actuator selectively ejecting ink from the opened ends of the ejection channels at the second end surface.

BRIEF DESCRIPTION OF THE DRAWINGS

The above and other objects, features and advantages of the invention will become more apparent from reading the following description of the preferred embodiment taken in connection with the accompanying drawings in which:

FIG. 7(*b*) is a side sectional view of the manifold of FIG. 7(*a*) taken along a line VIIB—VIIB;

FIG. 12(*b*) is a side sectional view showing an ink-jet print head unit, mounted in the ink-jet print device of FIG. 3, the ink-jet print head of the second embodiment being mounted in the ink-jet print head unit;

FIG. 13(*b*) is a side sectional view of the manifold of FIG. 13(*a*) taken along a line XIIIB—XIIIB;

DETAILED DESCRIPTION OF THE PREFERRED EMBODIMENTS

Figure 1:
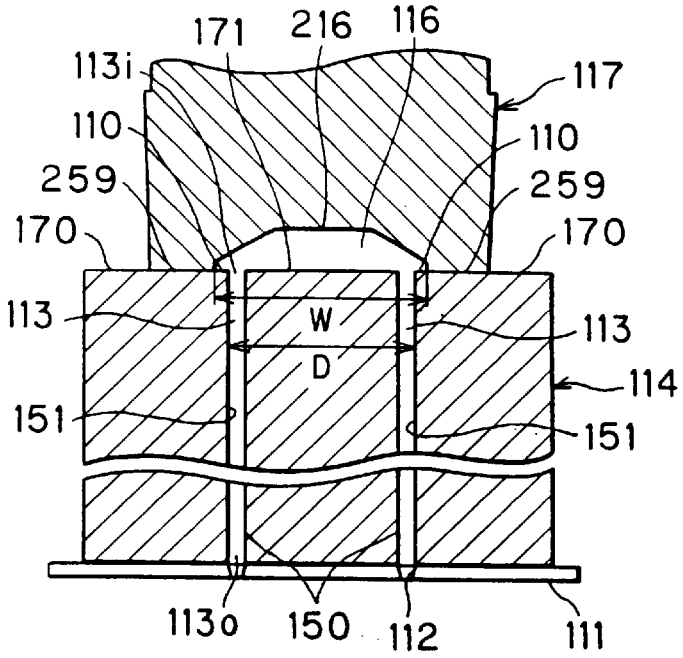
FIG. 1 is a cross-sectional side view of an essential part of a conceivable ink-jet print head.
Figure 2:
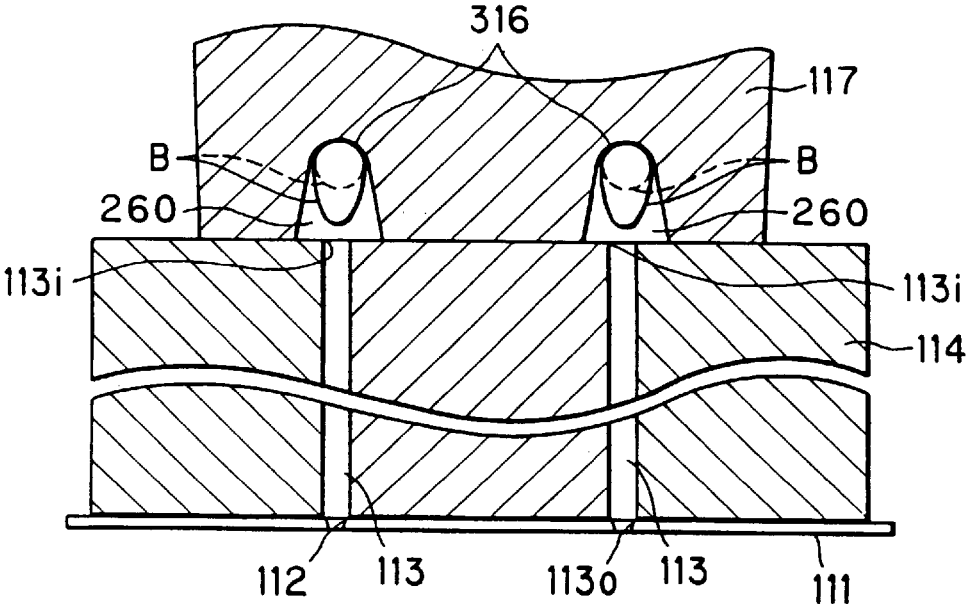
FIG. 2 is a cross-sectional side view of an essential part of another conceivable ink-jet print head.

An ink jet print head according to preferred embodiments of the present invention will be described while referring to the accompanying drawings wherein like parts and components are designated by the same reference numerals to avoid duplicating description.

An ink jet print head according to a first preferred embodiment will be described below with reference to FIGS. 3 through 11.

Figure 3:
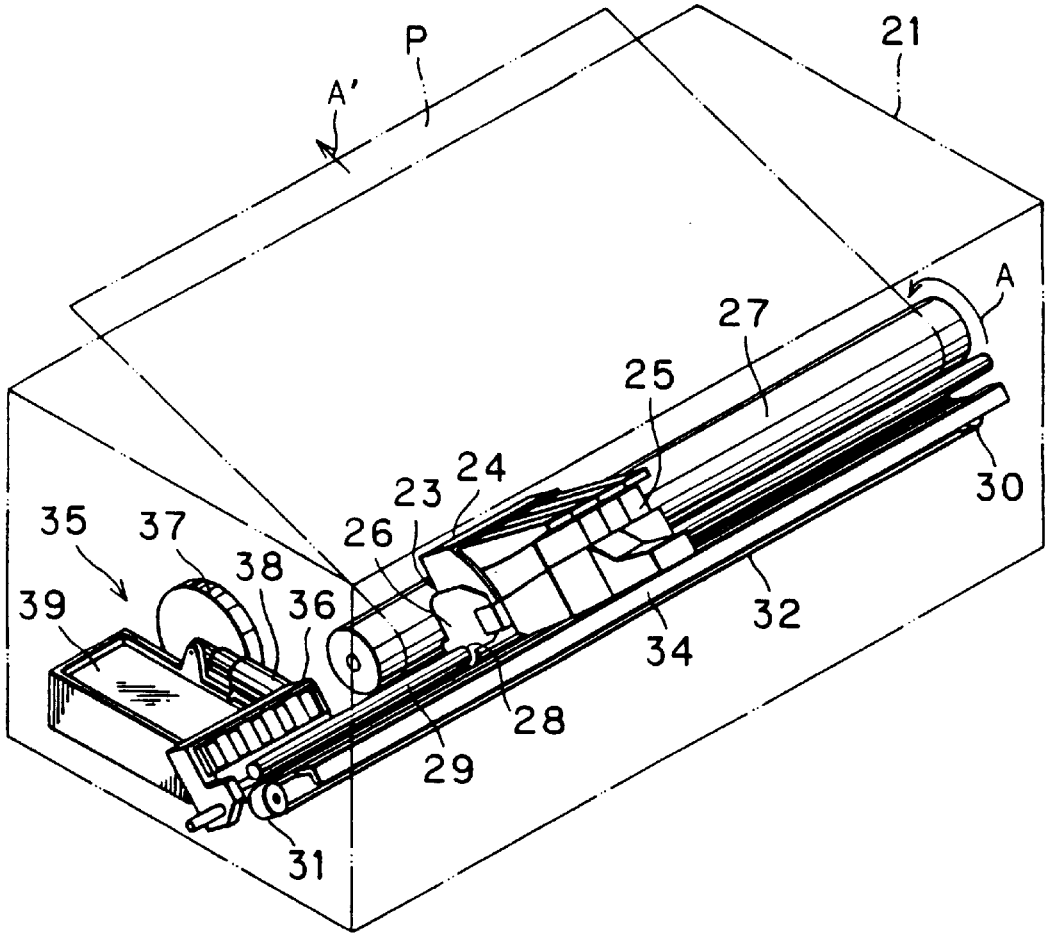
FIG. 3 is a perspective view of an ink-jet print device.

FIG. 3 shows a color ink-jet printer 21 of the first embodiment for printing color images on a printing paper P. The ink-jet printer 21 includes a paper supply cassette (not shown) for containing printing papers P to be fed into the ink-jet printer 21; a platen roller 27 for guiding the printing paper P inward during the printing operation and expelling the printing paper P outward when the printing operation is completed; an ink-jet print head unit 24 for printing color ink on the printing paper P; a carriage 26 for supporting the ink-jet print head unit 24 near the platen roller 27 and for moving the ink-jet print head unit 24 in a direction parallel to the platen roller 27 during the printing process: and a purge device 35 disposed near to one end of the platen roller 27 for removing both air bubbles that have been collected in the ink-Jet print head unit 24 and ink drops deposited on the outer ejection 25 surface of the ink-jet print head unit 24.

The paper supply cassette (not shown) is disposed in the top surface on the back of the ink-jet printer 21 and contains a plurality of sheets of printing paper P. During a printing operation, one printing paper P is fed at a time into a printing section, where the ink-jet print head unit 24 is movably provided with respect to the platen roller 27. The platen roller 27 is freely rotatable and is disposed in opposition to the front surface of the ink-jet print head unit 24 and parallel to the transport path of the same. Here, the transport path indicates the path along which the ink-jet print head unit 24 is moved during printing operations. The ink-jet print head unit 24 will be described in more detail later.

During a printing operation, the printing paper P is guided between the ink-jet print head unit 24 and the platen roller 27, which is driven to rotate in a direction A indicated by an arrow in FIG. 3. The printing paper P is expelled from the ink-jet printer 21 in another direction A' indicated by another arrow in the figure after the printing operation is completed. It is noted that the feeding mechanism for feeding the printing paper P has been omitted from the drawing.

The carriage 26 is provided for supporting the ink-jet print head unit 24 and four ink cartridges 25 at a predetermined declining angle. In order to support the carriage 26, a carriage shaft 29 is disposed parallel to and extending along the transport path of the ink-jet print head unit 24; and a guide plate 34 is disposed parallel to the carriage shaft 29. Thus, the carriage shaft 29 and the guide plate 34 extend along the platen roller 27. The carriage 26 Is formed with a carriage's haft support portion 28 at its bottom portion. The carriage shaft 29 passes through the carriage shaft support portion 28. Hence, the carriage 26 is slidably supported at the predetermined declining angle on the carriage shaft 29 via the carriage shaft support portion 28 and on the guide plate 34. Further, pulleys 30 and 31 are disposed approximately one on each end of the carriage shaft 29. A belt 32 for moving the carriage 26 in the transport path parallel to the platen roller 27 is stretched around the pulleys 30 and 31, linking them together, and is attached to the carriage 26. A motor (not shown) is provided for driving the pulley 30 to rotate, thereby moving the belt 32 and conveying the carriage 26 along the transport path.

The ink-jet print head unit 24 and the four ink cartridges 25 are detachably mounted on the carriage 26 and, therefore, can also be moved in the transport path parallel to the platen roller 27. Each of the ink cartridges 25 serves as an ink supply source for supplying ink to the ink-jet print head unit 24. The four ink cartridges 25 are for supplying four colors of ink, including cyan, magenta, yellow, and black. The ink-jet print head unit 24 is provided for printing images on the printing paper P in the above-described four colors. The print head unit 24 is constructed from four ink-jet print heads 23. Each ink-jet print head 23 is connected in fluid communication with a corresponding ink cartridge 25 when the ink-jet print head 23 and the corresponding ink cartridge 25 are mounted to the carriage 26. The print head unit 24 is mounted on the carriage 26 such that the ink-jet print head 23 ejects liquid ink at an angle slantedly downwardly onto the printing paper P.

In this way, the movement of the carriage 26 and the movement of the recording paper P cooperate to print desired images on the recording paper P through controlling the ink-jet print head unit 24 to eject ink on desired areas of the recording paper P.

The purge device 35 is disposed near to one end of the platen roller 27. The purge device 35 is positioned opposite to a reset position for each ink-jet print head 23. Here, the reset position indicates the position where the ink-jet print head 23 is located to be subjected to a purging operations. Each ink-jet print head 23 in the ink-jet print head unit 24 can sometimes develop problems in ejecting ink. These problems are usually caused by air bubbles generated in the print head 23 during an initial ink introduction timing or during other timings such as printing timings. These problems are also caused by ink drops deposited on the ejection surface of the print head 23. The purge device 35 is provided for removing, through suction, ink containing air bubbles in the ink-jet print head 23 and causing the ink-jet print head 23 to restore its good quality ejection condition.

In the purge device 35, a cap 36 is disposed in front of and opposing the reset position of the ink-jet print head 23. A pump 38 is provided to be driven by a cam 37 to develop a negative pressure, thereby sucking a predetermined amount of inferior ink, such as ink containing air bubbles, from the inside of the ink-jet print head 23. The inferior ink thus sucked from the ink-jet print head 23 is disposed in an ink disposal tank 39.

With the purge device 35 having the above-described structure, when the carriage 26 carries the ink-jet print head unit 24 so that one ink-jet print head 23, desired to be subjected to the purge operation, is brought into the reset position, the cap 36 covers the ink-jet print head 23. The pump 38 is driven by the cam 37 to remove, through suction, inferior ink from the inside of the ink-jet print head 23. The inferior ink is disposed in the disposal tank 39.

Each ink-jet print head 23, to be assembled into the ink-jet print head unit 24, will be described below in greater detail. Directional terms, such as up and down, will be used in the following description with reference to the state of the ink-jet print head unit 23 located in an orientation shown in FIG. 6.

Figure 4:
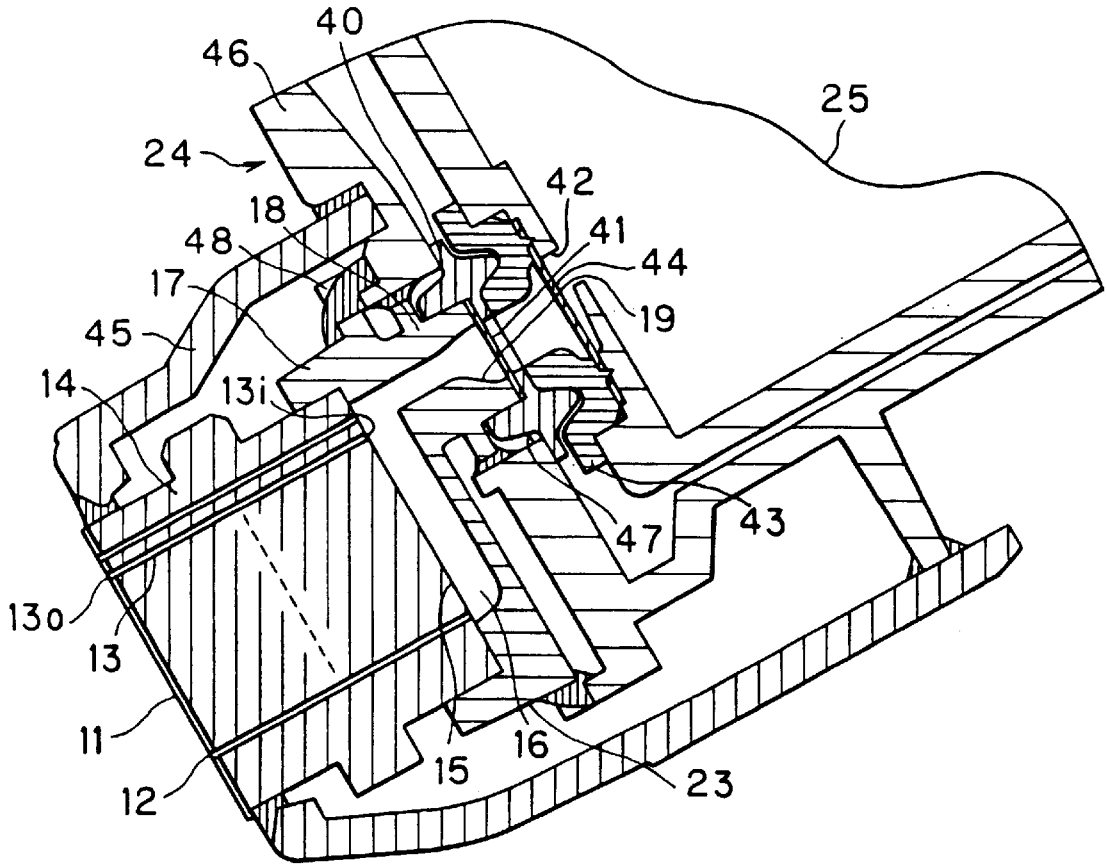
FIG. 4 is a side sectional view showing an ink-jet print head unit, mounted in the ink-jet print device of FIG. 3, an ink-jet print head of a first embodiment of the present invention being mounted in the ink-jet print head unit.
Figure 5:
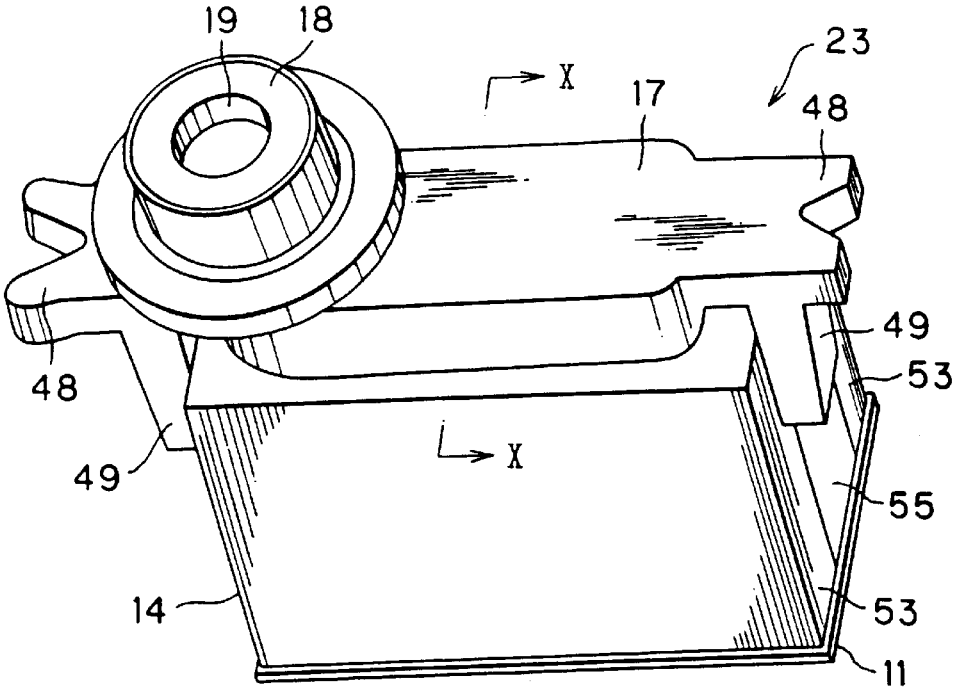
FIG. 5 is a perspective view of the ink-jet print head according to the first embodiment.

As shown in FIGS. 4 and 5, the ink-jet print head 23 includes: an actuator 14, a nozzle plate 11, and a manifold 17. The nozzle plate 11 is formed with a plurality of nozzle holes 12 for ejecting liquid ink. The actuator 14 has upper and lower end surfaces opposite to each other. The actuator 14 is formed with a plurality of ejection channels 13 in a plurality of (two, for example) rows. Each ejection channel 13 extends between the upper and lower end surfaces. Thus, each ejection channel 13 is opened on the upper end surface to have an inflow end **13*i* for receiving ink to flow in the ejection channel 13, and is opened on the lower end surface to have an outflow end 130 for flowing ink out of the ejection channel 13**.

The nozzle plate 11 is attached to the lower end surface (outflow end surface) of the actuator 14 so that the outflow end 130 of each ejection channel 13 is connected to a corresponding nozzle hole 12 in the nozzle plate 11. The manifold 17 is connected with the upper end surface (inflow end surface) of the actuator 14.

The structure of the actuator 14 will be described below in greater detail.

Figure 8:
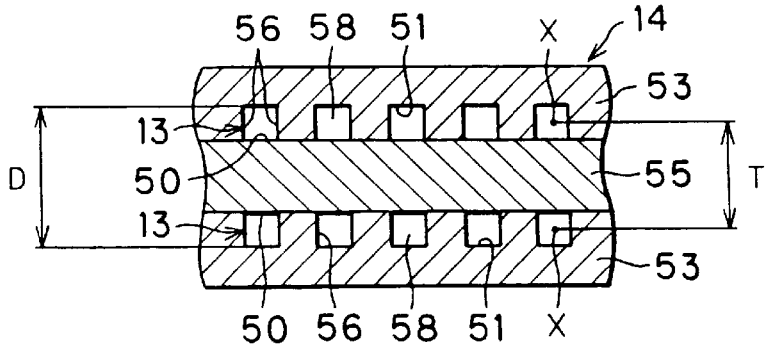
FIG. 8 is a across-sectional view of the ink-jet print head of the first embodiment taken along a line VIII—VIII in FIG. 5.
Figure 10:
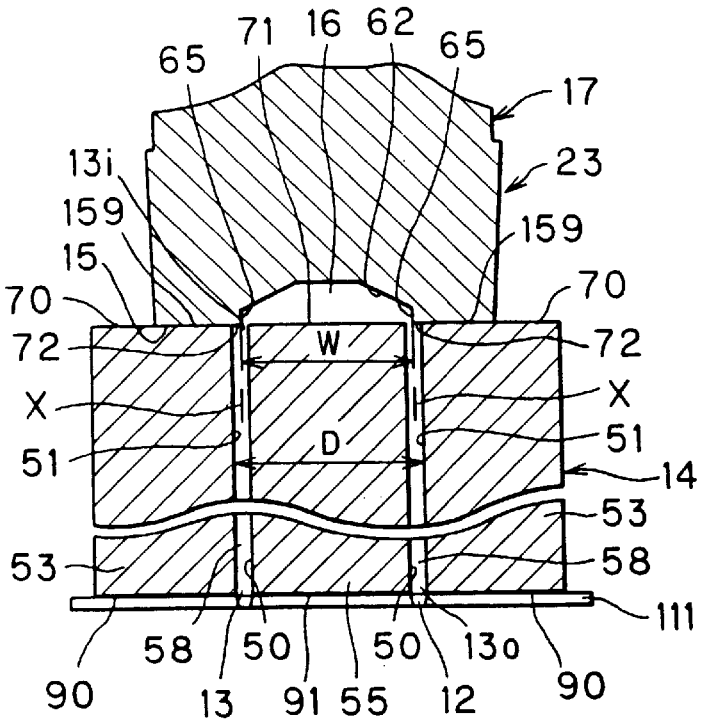
FIG. 10 is a cross-sectional side view of an essential part of the ink-jet print head of the first embodiment taken along a line X—X in FIG. 5.

As shown in FIGS. 5, 8 and 10, the actuator 14 is constructed from a pair of base plates 53 and 53 and a center plate 55 interposed between the pair of base plates 53 and 53. Each of the base plates 53- and 53 is formed from a piezoelectric ceramic element. Each base plate 53 is formed with a plurality of grooves 58. The plurality of grooves 58 are arranged as separated from one another in each base plate 53. That is, each groove 58 is defined by opposite side inner walls 56 and an outer side inner wall 51. The base plates 53 and 53 are joined to the center plate 55 on both opposite sides 50 of the center plate 55, respectively, forming the plurality of ejection channels 13 in two rows. That is, the opposite side walls 50 and 50 of the central plate 55 define the inner side walls of the ejection channels 13. The outer side inner walls 51 of the grooves 58 define outer side walls of the ejection channels 13. Thus, the two rows of opposing ejection channels 13 are formed in the actuator 14, interposed by the central plate 55. It is noted that the outer side inner walls 51 in one base plate 53 are spaced from the outer side inner walls 51 in the other base plate 53 by a predetermined distance D. A predetermined distance T (<D) is provided between centers X in the ejection channels 13 in one base plate 53 and centers X in the ejection channels 13 in the other base plate 53.

As shown in FIG. 10, each base plate 53 has an upper end surface 70 and a lower end surface 90 opposite to the upper end surface 70. The grooves 58 are formed to extend between the upper and lower end surfaces 70 and 90. The outer side inner walls 51 therefore extend between the upper and lower end surfaces 70 and 90 as shown in FIG. 10. The central plate 55 has an upper end surface 71 and a lower end surface 91 opposed to the upper end surface 71. Accordingly, the opposite side walls 50 of the central plate 55 extends between the upper and lower end surfaces 71 and 91. Thus, the ejection channels 13, defined by the outer side inner walls 51 and the opposite side walls 50, extend between the upper and lower end surfaces of the actuator 14. Each ejection channel 13 has an inflow end 13*i* on the upper end surface and an outflow end 13*o* on the lower end surface. The inflow end 13*i* is defined between an outer edge of the upper end surface 71 and an inner edge 72 of the upper end surface 70. The outflow end 13*o* is defined between an outer edge of the lower end surface 91 and an inner edge of the lower end surface 90. It is noted that the height of the central plate 55, defined between its end surfaces 71 and 91. is equal to that of each base plate 53, defined between its end surfaces 70 and 90.

As shown in FIGS. 4 and 10, the nozzle plate 11 is formed with two rows of through-holes 12. The nozzle plate 11 is attached to the lower surfaces 90 of the base plates 53 and 53 and the lower surface 91 of the central plate 55 so that the two rows of through-holes 12 are brought into fluid communication with the two rows of ejection channels 13. Because the height of the central plate 55 between the upper and lower end surfaces 71 and 91 is equal to that of each base plate 53 between the upper and lower end surfaces 70 and 90, the upper end surface 71 of the central plate 55 is located in the same plane with the upper end surfaces 70 of the base plates 53.

The manifold 17 will be described below in greater detail.

Figure 6:
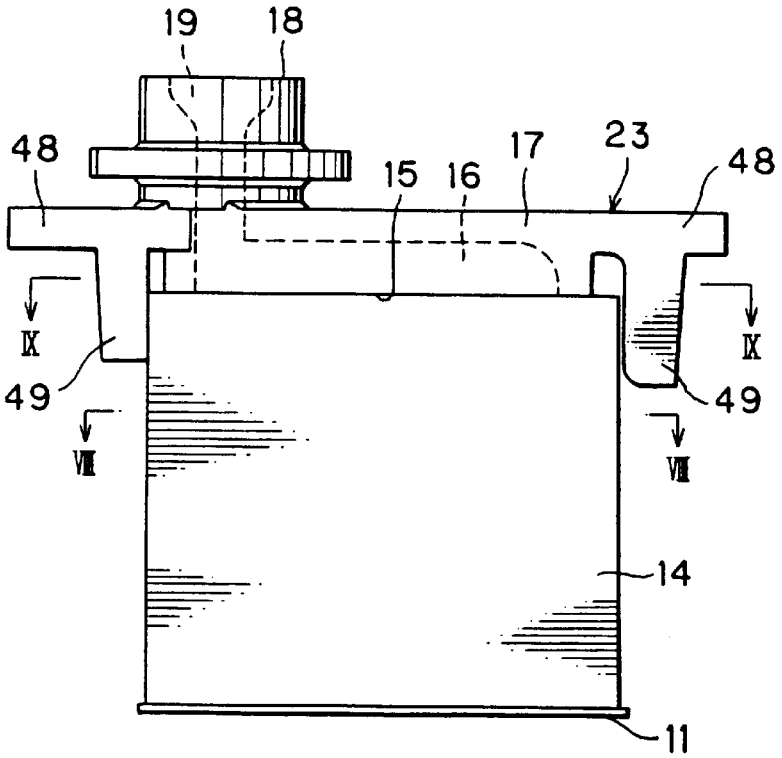
FIG. 6 is a side view of the ink-jet print head of the first embodiment.
Figure 7A:
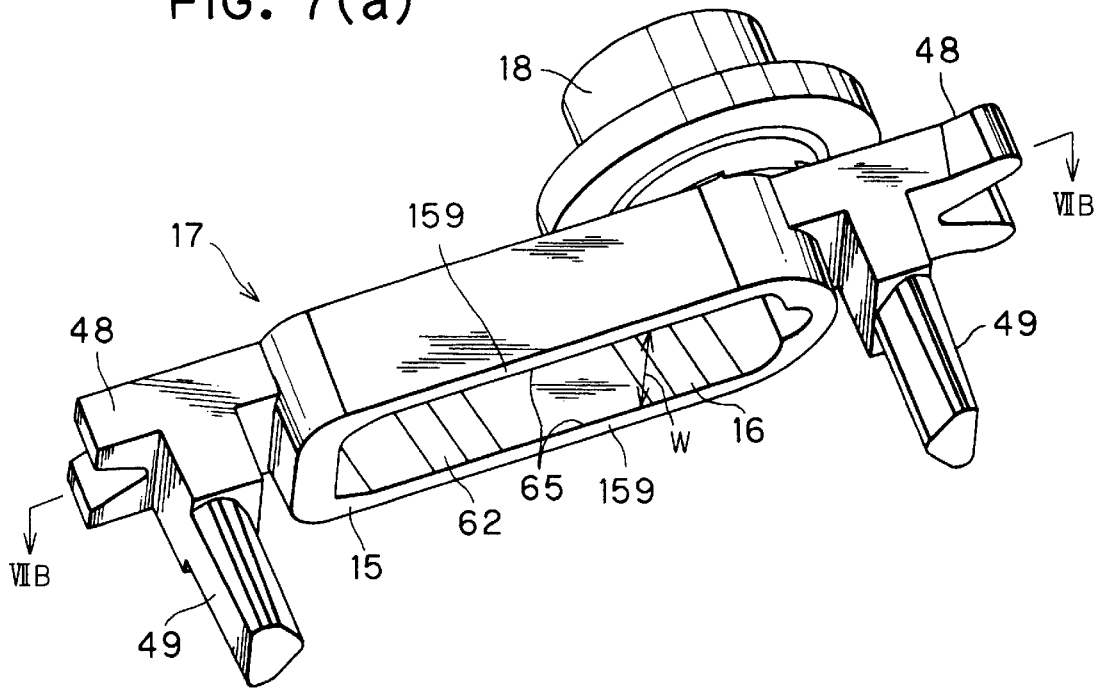
FIG. 7(*a*) is a perspective view of a manifold to be assembled to the ink-jet print head of the first embodiment.
Figure 7B:
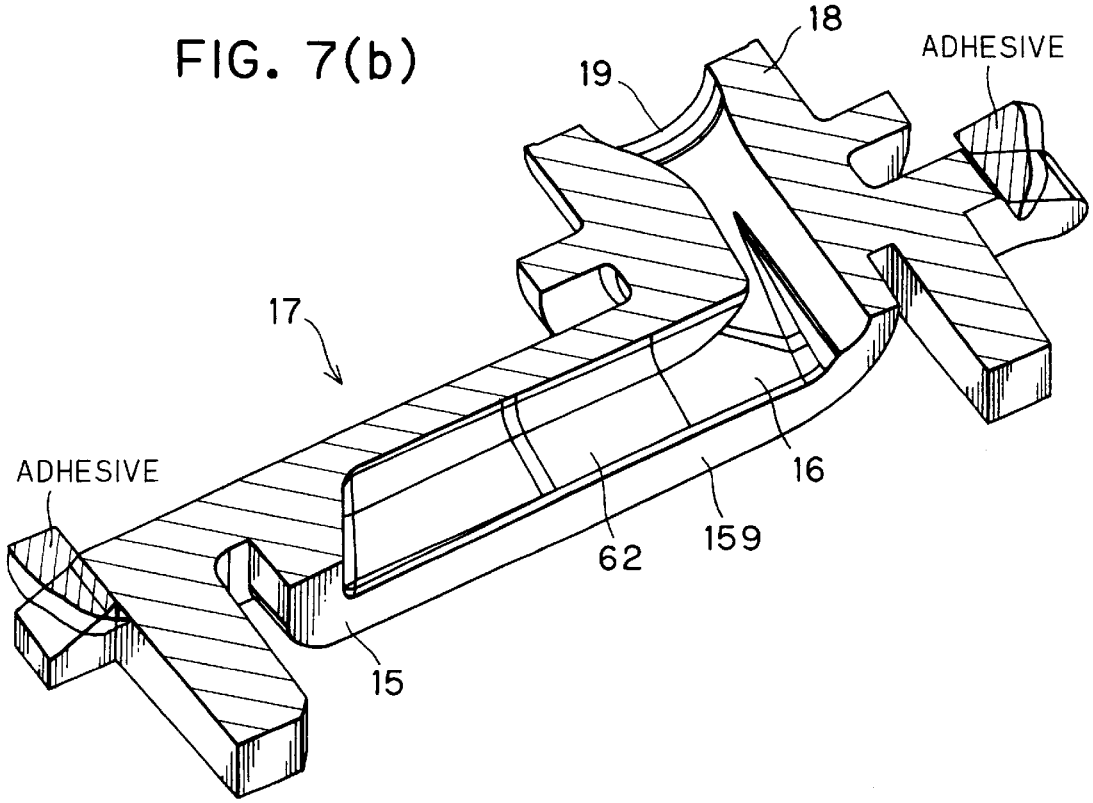

As shown in FIGS. 6 through 7(*b*), the manifold 17 is formed with an ink supply channel 16. The ink supply channel 16 has an approximately arc-shaped cross-section as shown in FIG. 10, and is opened at a lower end surface 15 of the manifold 17. More specifically, the lower end surface 15 of the manifold 17 is designed to have a pair of outside areas 159 and 159 for surrounding an opened area of the ink supply channel 16 therebetween. The outside areas 159 and 159 are on the same plane with each other. Each outside area 159 has an inner edge 65 which defines. an edge of the opened area of the ink supply channel 16. More specifically, the manifold 17 is formed with an inner wall 62 which extends from the inner edges 65 of the outside areas 159 and which provides the concave-shaped ink supply channel 16 having the U-shaped cross-section.

According to the present embodiment, the width W of the ink supply channel 16 at its open end is smaller than or equal to the distance D between the outer side walls 51 and 51 in the two rows of ejection channels 13, where the width W is defined as a distance between the inner edges 65 of the outside areas 159. The width W is set approximately equal to the distance T between the centers X of the ejection channels 13 in the two rows.

As shown in FIG. 5, a mouth portion 18 is provided on an upper exterior surface of the manifold 17 opposite to the lower end surface 15. As shown in FIGS. 5 through 7(*b*), an inflow opening 19 is formed through the mouth portion 18 in fluid communication with the ink supply channel 16, providing a passage for supplying ink to the ink supply channel 16 from a corresponding ink cartridge 25 (not shown) as will be described later. The manifold 17 is further provided with a pair of mounting members 48 for ensuring that the manifold 17 is firmly attached to the carriage 26 as will be described later. The manifold 17 to further provided with a pair of attaching members 49 for fixedly securing the actuator 14 to the manifold 17.

The manifold 17 having the above-described structure is connected to the actuator 14 as described below.

Figure 9:
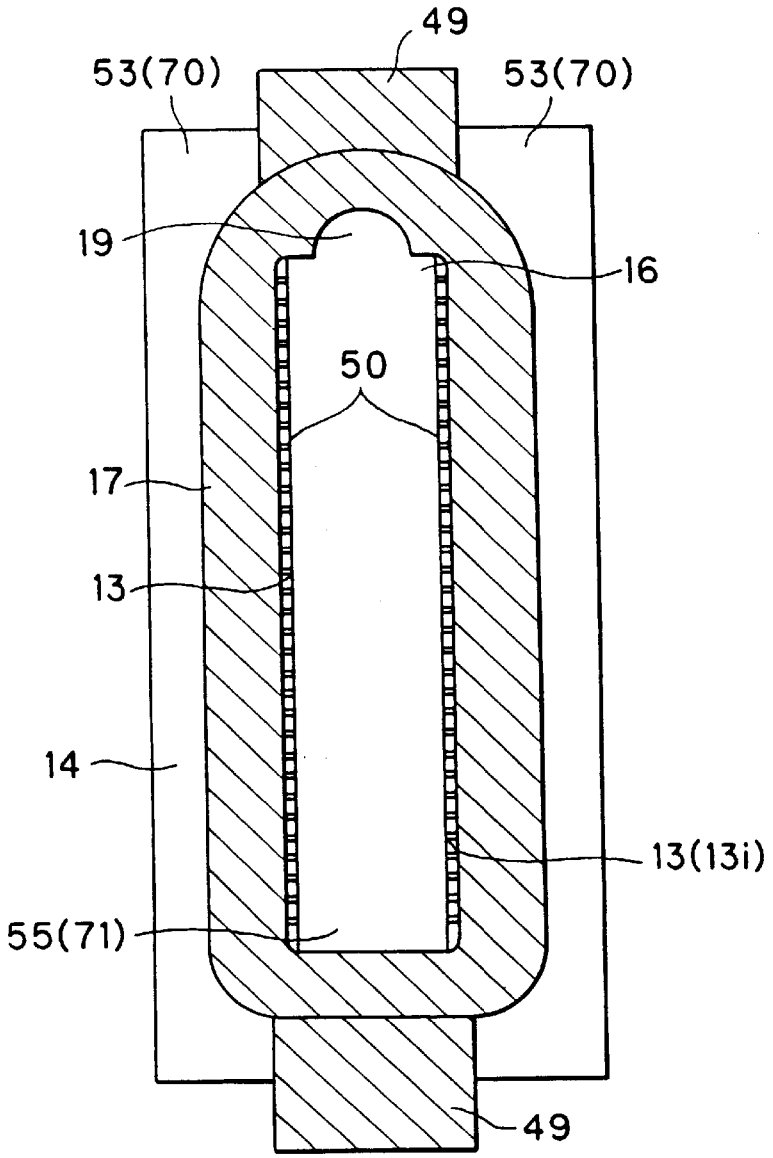
FIG. 9 is a cross-sectional view of the ink-jet print head of the first embodiment taken along a line IX—IX in FIG. 6.

The actuator 14, which is attached with the nozzle plate 11, is located between the attaching members 49 and 49 as shown in FIG. 5. In this condition, the ink supply channel 16 extends along the two rows of ejection channels 13 as shown in FIG. 9. The inflow-ends 13*i* of all the ejection channels 13 in the two rows are brought into fluid communication with the ink supply channel 16.

Then, the lower end surface 15 of the manifold 17 is attached via adhesive to the upper end surface (inflow end surface) of the actuator 14. That is, the outside areas 159 and 159 of the manifold 17 are bonded to the upper end surfaces 70 and 70 of the base plates 53 and 53 as shown in FIG. 10.

As described above, the width W of the ink supply channel 16 at its open end is smaller than the distance D between the outer side walls 51 and 51 of the two rows of ejection channels 13 and is approximately equal to the distance between the centers X of the ejection channels 13 in the two rows. The manifold.17 is therefore joined to the actuator 14 so that the inner edges 65 of the outer side areas 159 are positioned substantially at the centers X of the ejection channels 13.

When the manifold 17 is thus joined to the actuator 14, the ink supply channel 16 becomes properly surrounded not only by the inner wall 62 but also by the upper end surface 71 of the central plate 55 as shown in FIGS. 9 and 10. The ink supply channel 16 is brought into fluid communication with the inflow openings 13*i* of all the ejection channels 13 in the two rows. The ink supply channel 16 will therefore serve to supply liquid ink from a connected ink cartridge 25 to each of the ejection channels 13 as will be described later.

Hence, by forming the ink supply channel 16 with the width W equal to or less than the distance D between the outer side walls 51 and 51 of the two rows of ejection channels, as shown in FIG. 10, any protruding margin portions will not be formed on the outer end surfaces 70 of the actuator 14 where the actuator 14 is joined with the manifold 17. As a result, the liquid ink flowing within the ink supply channel 16 can flow along the inner surface 62 and smoothly flow into the ejection channels 13 without generating any air bubbles within the ink supply channel 16. Hence, generation and accumulation of residual air bubbles can be suppressed, thereby suppressing undesirable ejection problems.

According to the present embodiment, the width W of the ink supply channel 16 at its opened end is set almost equal to the distance between the centers X of the channels 13 in the two rows. Even when there is a discrepancy in position where the manifold 17 is joined with the actuator 14 during a manufacturing procedure, the discrepancy will approximately be distributed in the normal distribution. Accordingly, the manifold 17 and the actuator 14 can be joined with each other so that the inner edges 65 of the outer side surfaces 159 are positioned at the midpoints of the ejection channels 13. Accordingly, the likelihood of margin portions being formed on the outer side areas 70 of the actuator 14 can be decreased even further, effectively reducing the production of defective products.

Figure 11:
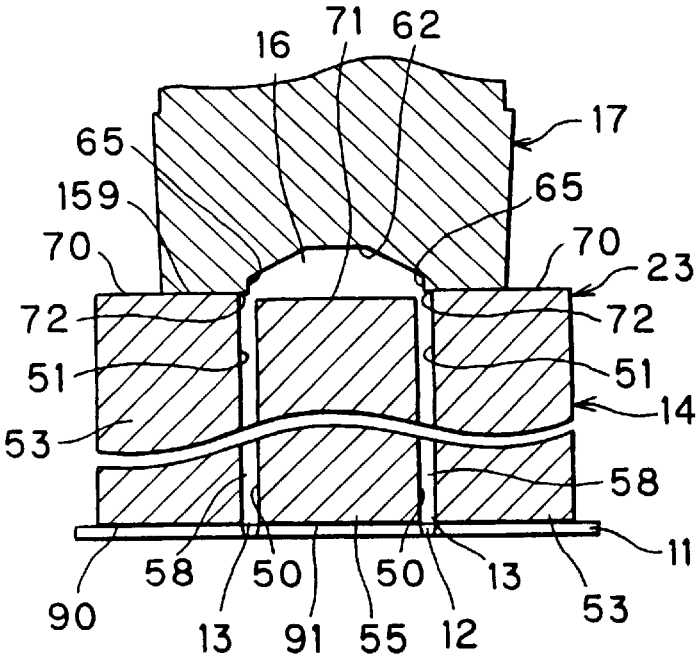
FIG. 11 is a cross-sectional side view corresponding to FIG. 10 in a modification of the first embodiment.

The height of the center plate 55 between the upper and lower end surfaces 71 and 91 may be set slightly smaller than that of each base plate 53 between the upper and lower end surfaces 70 and 90 as shown in FIG. 11. Also in this case, the nozzle plate 11 is bonded to the lower end surfaces 90 of the base plates 53 and the lower end surface 91 of the central plate 55. The upper end surface 71 of the center plate 55 is therefore located as shifted closer to the nozzle plate 11 than the upper end surfaces 70 of the base plates 53. Accordingly, the distance between the edges 65 of the outer side areas 159 and the inner side walls 50 of the ejection channels 13 is increased. Therefore, even if the edges 65 of the outer side areas 159 are not properly centered in the ejection channels 13 when the manifold 17 and the actuator 14 are joined together, the ejection channels 13 will not be blocked. It is possible to ensure that an ink flow path is provided between the ink supply path 16 and the ejection channels 13.

In the ink-jet print head 23, the inner side walls 50 and 50 of the two rows of ejection channels 13 are formed by the opposite side surfaces of the central plate 55. By simply designing the central plate 55 as smaller than the base plates 53 and shifting the central plate 55 in a downward direction relative to the base plates 53 and 53, the distance between the inner side walls 50 of the ejection channels 13 and the edges 65 of the ink supply channel 16 can be increased. Accordingly, the ink paths from the ink supply channel 16 to the ejection channels 13 can be easily ensured using this simple construction method.

Four ink-jet print heads 23, each being assembled as described above and as shown in FIG. 5, are attached to a head unit wall 46 as shown in FIG. 4. The head unit wall 46 is a part of the carriage 26 in FIG. 3. As a result, the four ink-jet print heads 23 are united together into the ink-jet print head unit 24. Four ink cartridges 25 are also attached to the head unit wall 46 from an opposite side of the ink-jet print heads 23. Thus, the four ink cartridges 25 are connected to the respective ink-jet print heads 23 via the head unit wall 46. A head unit cover 45 is provided in connection with the head unit wall 46 for covering all the four ink-jet print heads 23 mounted to the head unit wall 46.

Each ink-jet print head 23 and the corresponding ink cartridge 25 are connected to the head unit wall 46 in a manner described below.

A through-hole 47 is formed to penetrate the head unit wall 46. The mouth portion 18 of the manifold 17 is inserted into this through-hole 47. The pair of mounting members 48 and 48 are attached via adhesive to the head unit wall 46 as shown in FIG. 7(*b*). Thus, the manifold 17 is fixedly attached to the head unit wall 46. A sealing member 40 is fitted into a gap between the mouth portion 18 and the through-hole 47. A first filter 41 is interposed between the sealing member 40 and the mouth portion 18 for preventing air bubbles and foreign matter from entering the ink supply channel 16 when the ink cartridge 25 is connected to the head unit vertical wall 46.

As shown in FIG. 4, each ink cartridge 25 is formed with an ink supply opening 42. An adapter 43 is fitted into the ink supply opening 42 for connecting the ink cartridge 25 to the sealing member 40. A second filter 44 is interposed between the ink supply opening 42 and the adapter 43 for preventing liquid ink from flowing out of the ink supply opening 42 when the ink cartridge 25 is connected to the ink-jet print head 23. The liquid ink is prevented from spilling out through the ink supply opening 42 by the surface tension of the ink established on the second filter 44.

The ink cartridge 25 is detachably connected to the manifold 17 through fitting the adapter 43 into the sealing member 40. As a result, the inside of the ink cartridge 25 is brought into fluid communication with the ink supply channel 16 via the ink supply opening 42 and the inflow opening 19. The liquid ink stored in the inside of the ink cartridge 25 is introduced into the inflow opening 19 from the ink supply opening 42 via the adapter 43 and the sealing member 40.

When the ink-jet print head 23 and the ink cartridge 25 are thus mounted to the head unit wall 46, the ink-jet print head 23 and the ink cartridge 25 are disposed at a downward slant of about 45 degrees, for example, as shown in FIG. 4. Accordingly, the nozzle plate 11 is disposed facing slantedly downward, and the manifold 17 is disposed above the nozzle plate 11 via the actuator 14.

In this posture of the ink-jet print head 23 and the ink cartridge 25, liquid ink from the ink cartridge 25 flows into the manifold 17 via the inflow opening 19 and enters the ink supply channel 16. Ink flowing within the ink supply channel 16 is supplied to the ejection channels 13. The actuator 14 is partially applied with electric fields, and transformed. This transformation causes changes in the volume of ejection channels 13 to be actuated. When the volume of the ejection channel 13 is decreased, the liquid ink in that channel is ejected slantedly downwardly from the nozzle hole 12 formed in the nozzle plate 11 and onto the printing paper P. When the volume of the ejection channel 13 is increased, on the other hand, ink from the ink cartridge 25 is introduced into the ejection channel 13 via the ink supply channel 16.

As described above, the actuator 14 is formed with the plurality of ejection channels 13 in two rows which are spaced apart from each other at the prescribed distance. Each of the ejection channels 13 has an inflow end 13*i* for receiving ink flowing into the ejection channel 13 and an outflow end 13*o* for flowing ink out of the ejection channel. The manifold 17 is joined with the inflow end surface of the actuator 14. The manifold 17 is formed with the ink supply channel 16 for supplying liquid ink from the ink cartridge 25 to each of the ejection channels 13. The ink supply channel 16 is formed to extend along the rows of the ejection channels 13 to be opened over the inflow ends 13*i* of the ejection channels 13. The width W of the ink supply channel 16, opened at the surface of the manifold 17 as connected to the actuator 14, is less than or equal to the distance D between the outer side inner walls 51 and 51 of the two row of ejection channels 13. According to this construction, any margin portions, extending outward from the outer side edges 51 of the ejection channels 13, are not formed to be exposed in the ink supply channel 16. As a result, the liquid ink flowing within the ink supply channel 16 along the inner wall surface 62 can smoothly flow into all the ejection channels 13 without generating air bubbles within the ink supply channel 16. Hence, the accumulation of air bubbles can be effectively suppressed, thereby decreasing the number of ejection problems.

Especially, the width W of the ink supply channel 16, as defined along the plane where the manifold 17 is joined with the actuator 14, is approximately the same as the distance T between the midpoints of the two rows of ejection channels. There may possibly occur a discrepancy in positioning when joining the manifold 17 with the actuator 14 during the production process. When this occurs, the surface 15 of the manifold 17, surrounding the opened end of the ink supply channel 16, can block the ink flowing paths to the ejection channels 13. However, such a position discrepancy will follow the normal distribution during manufacturing. Considering this tendency, the manifold 17 and the actuator 14 are joined such that the opening ends 65 of the inner wall 62 of the ink supply channel 16 are positioned substantially over the midpoints of the ejection channels. With this construction, the likelihood of the margin portions being formed on the outer sides of the ejection channels 13 can be decreased even further, effectively reducing the production of defective products.

Especially, in the modification of FIG. 11, the central area 71 in the upper end surface on the actuator 14, defined between the rows of ejection channels 13 and facing the manifold 17, is positioned closer to the nozzle plate 11 than the other remaining areas 70 of the upper end surface on the outer sides of the two rows of ejection channels 13. Accordingly, the distance between the opening ends 65 of the inner wall 62 of the ink supply channel 16 and the inner side walls 50 of the ejection channels 13 is increased. Therefore, even if the opening ends 65 of the inner wall 62 of the ink supply channel 16 are not properly centered in the ejection channels 13 when the manifold 17 and the actuator 14 are joined together, the ink paths to the ejection channels 13 will not be blocked.

In the present embodiment, the actuator 14 has the center plate 55 positioned between the two rows of ejection channels 13 and forming the inner side walls 50 of the ejection channels 13. By simply shifting the central plate 55 closer toward the nozzle plate 11, the distance between the opening ends 65 of the inner surface 62 in the ink supply channel 16 and the inner side walls 50 of the ejection channels 13 can be increased. Hence, the ink paths from the ink supply channel 16 to the ejection channels 13 can be sufficiently provided using the simple construction method.

An ink-jet print head 23 according to a second embodiment of the present invention will be described below with reference to FIGS. 12(*a*)–17.

Figure 14:
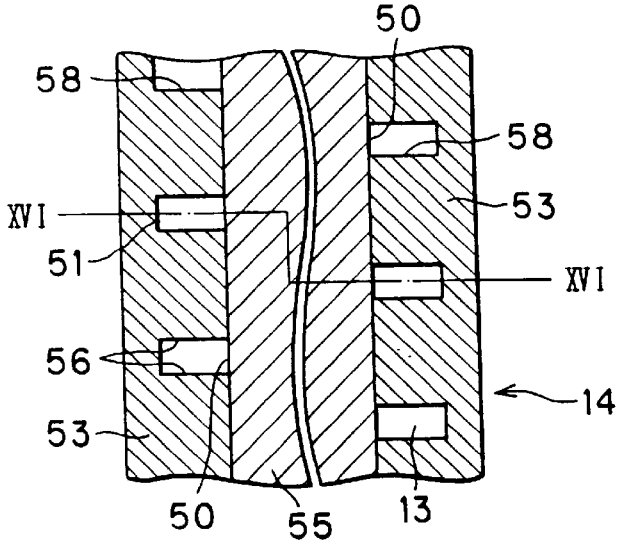
FIG. 14 is a cross-sectional view of the ink-jet print head of the second embodiment taken along a line XIV—XIV in FIG. 12(*a*)
Figure 16:
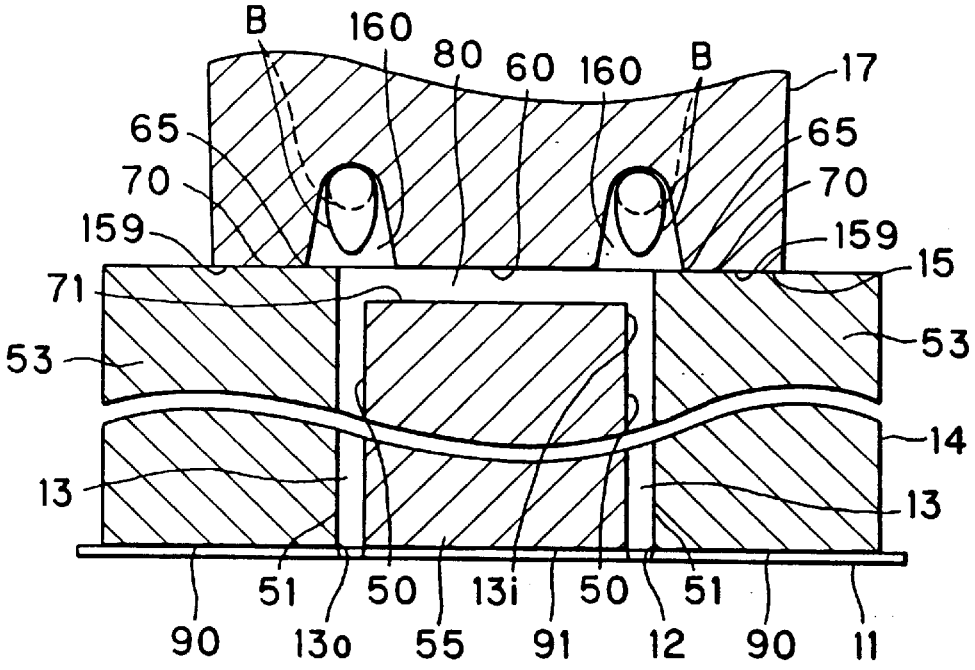
FIG. 16 is a cross-sectional side view of an essential part of the ink-jet print head of the second embodiment taken along a line XVI—XVI in FIGS. 12(*a*), 14, and 15.

The ink-jet print head 23 of the present embodiment has the same external view as shown in FIG. 5 of the first embodiment. Similarly to the first embodiment, the ink-jet print head 23 of the present embodiment includes: the actuator 14; the nozzle plate 11; and the manifold 17 as shown in FIG. 12(*a*). The actuator 14 of the present embodiment has almost the same structure as that of the first embodiment. That is, as shown in FIGS. 5, 14, and 16, the actuator 14 is constructed from: the pair of base plates 53 and 53 formed of a piezoelectric ceramic element; and the central plate 55 interposed between the pair of base plates 53 and 53. The plurality of grooves 58 are formed in each base plate 53. Each groove 58 is defined by an outer side inner wall 51 and opposite side walls 56. The base plates 53 and 53 are joined to the central plate 55 on its opposite sides 50 and 50, respectively, forming the plurality of ejection channels 13. Accordingly, the opposite side surfaces 50 and 50 of the central plate 55 define the inner side walls of the ejection channels 13, while the outer side inner walls 51 form the outer side walls of the ejection channels 13. Thus, two rows of opposing ejection channels 13 are formed in the actuator 14, interposed by the plate 55.

Similarly to the first embodiment, each ejection channel 13 has an inflow end 13*i* on the upper end surface of the actuator 14 and an outflow end 13*o* on the lower end surface of the actuator 14. The inflow end 13*i* is defined between an outer edge of the upper end surface 71 and an inner edge of the upper end surface 70. The outflow end 13*o* is defined between an outer edge of the lower end surface 91 and an inner edge of the lower end surface 90.

Figure 15:
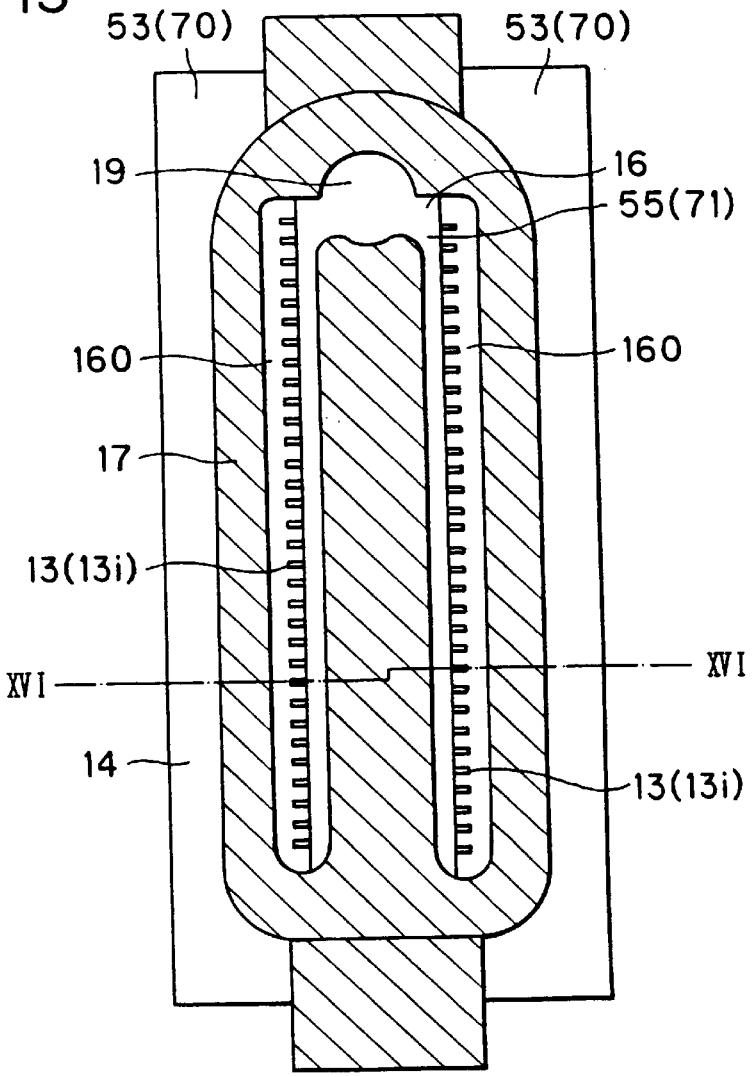
FIG. 15 is a cross-sectional view of the ink-jet print head of the second embodiment taken along a line XV—XV in FIG. 12(*a*)

It is noted that according to the present embodiment, the base plates 53 and 53 are positioned with respect to the central plate 55 so that the grooves 58 are arranged in a staggered manner as shown in FIG. 14. Accordingly, the inflow ends 13*i* of the ejection channels 13 in the two rows are arranged as staggered as shown in FIG. 15.

Similarly to the modification of the first embodiment, the height of the central plate 55 defined between its end surfaces 71 and 91 is slightly smaller than the height of each base plate 53 defined between its end surfaces 70 and 90 as shown in FIG. 16.

The nozzle plate 11 is formed with two rows of nozzles 12. The nozzles 12 are arranged in a staggered manner in correspondence with the ejection channels 13. Similarly to the first embodiment, the nozzle plate 11 is attached to the lower end surfaces 90 of the base plates 53 and 53 and the lower end surface 91 of the central plate 55 so that the two rows of through-holes 12 are brought into fluid communication with the two rows of ejection channels 13. Because the height of the central plate 55 is smaller than that of each base plate 53, the upper end surface 71 of the central plate 55 is shifted slightly closer to the nozzle plate 11 than the upper end surfaces 70 of the base plates 55.

Figure 13A:
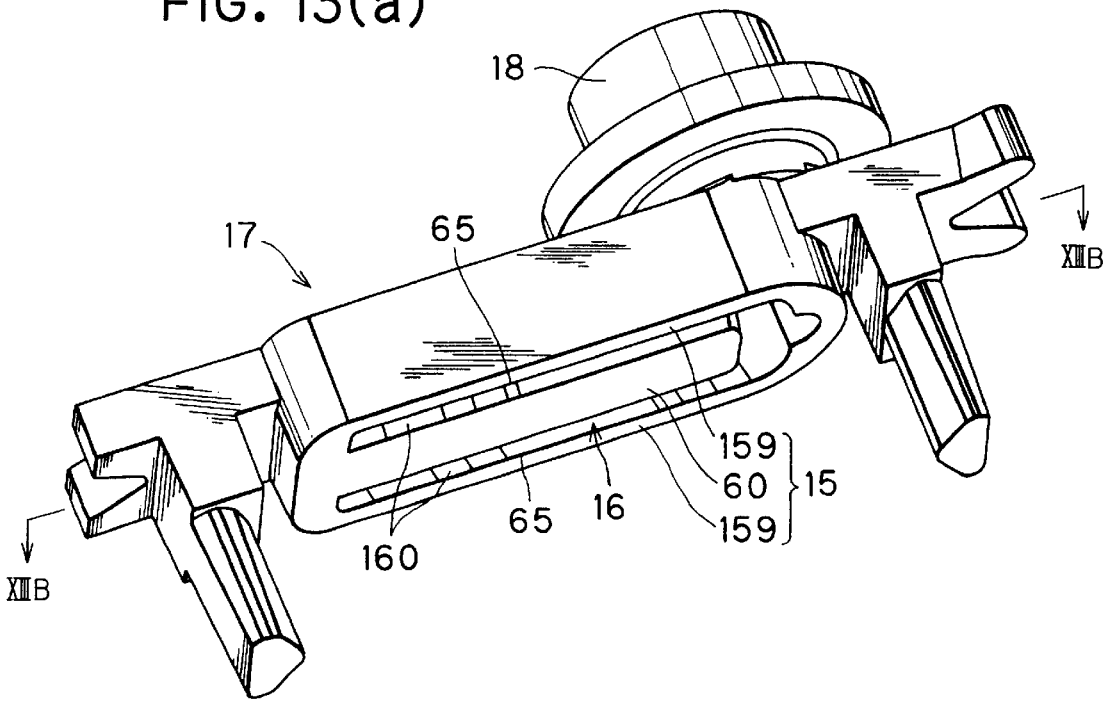
FIG. 13(*a*) is a manifold to be assembled to the ink-jet print head of the second embodiment.
Figure 13B:
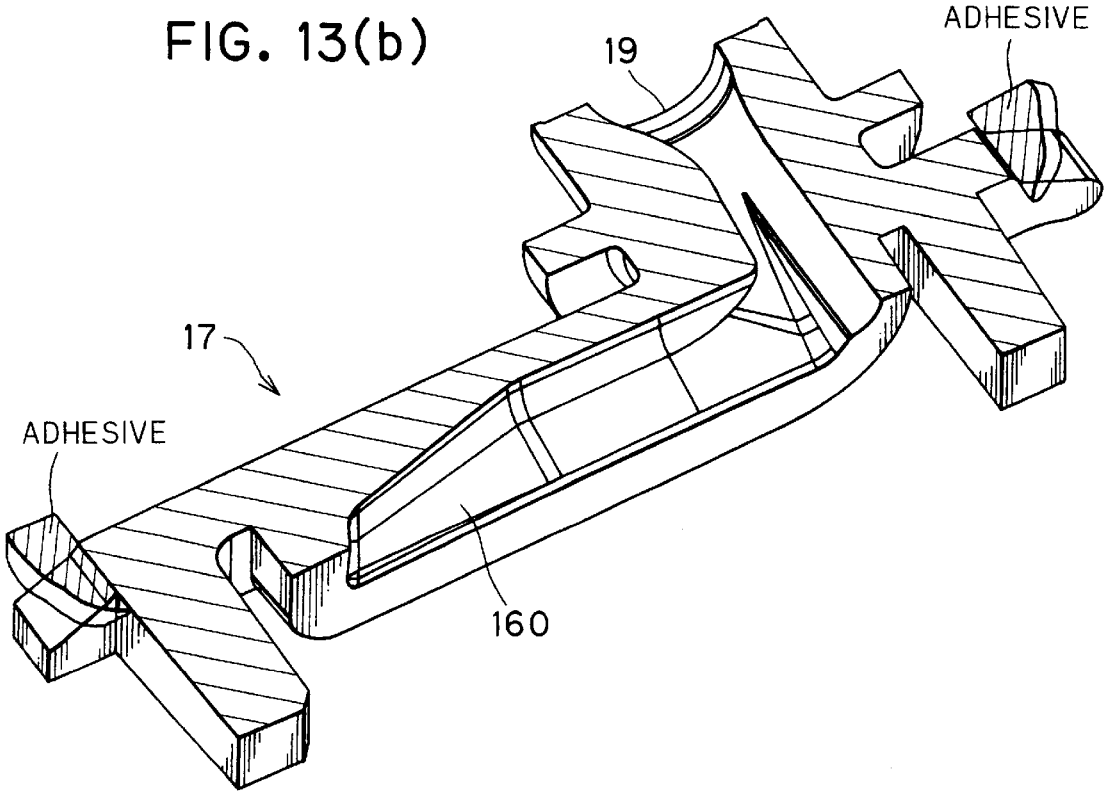

The structure of the manifold 17 in the present embodiment is the same as that of the first embodiment except for the shape of the ink supply channel 16. According to the present embodiment, the ink supply channel 16 is shaped as shown in FIGS. 13(*a*), 13(*b*), and 15. That is, the ink supply channel 16, formed in the manifold 17, is divided into two ink supply paths 160 and 160 which extend from the inflow opening 19. The two ink supply paths 160 and 160 are formed to extend or run along the two rows of ejection channels 13 as shown in FIG. 15 when the manifold 17 is attached to the actuator 14. All the ejection channels 13 in each row are brought into fluid communication with a corresponding ink supply path 160. With this structure, liquid ink flows from the inflow opening 19 into the ink supply channel 16, down both paths 160 and 160, and is introduced into the ejection channels 13 in each row.

More specifically. as shown in FIGS. 13(*a*) and 16, the two ink supply paths 160 are opened on the lower end surface 15 of the manifold 17. The lower end surface 15 of the manifold 17 therefore includes: a pair of outside areas 159 and 159 for surrounding the two paths 160 therebetween; and a central area 60 sandwiched between the two paths 160. The outside areas 159 and 159 and the central area 60 are on the same plane with one another. The manifold 17 is connected to the actuator 14 in such a manner that the outside areas 159 and 159 of the manifold 17 are bonded to the upper end surfaces 70 and 70 of the base plates 53 and 53.

Figure 12A:
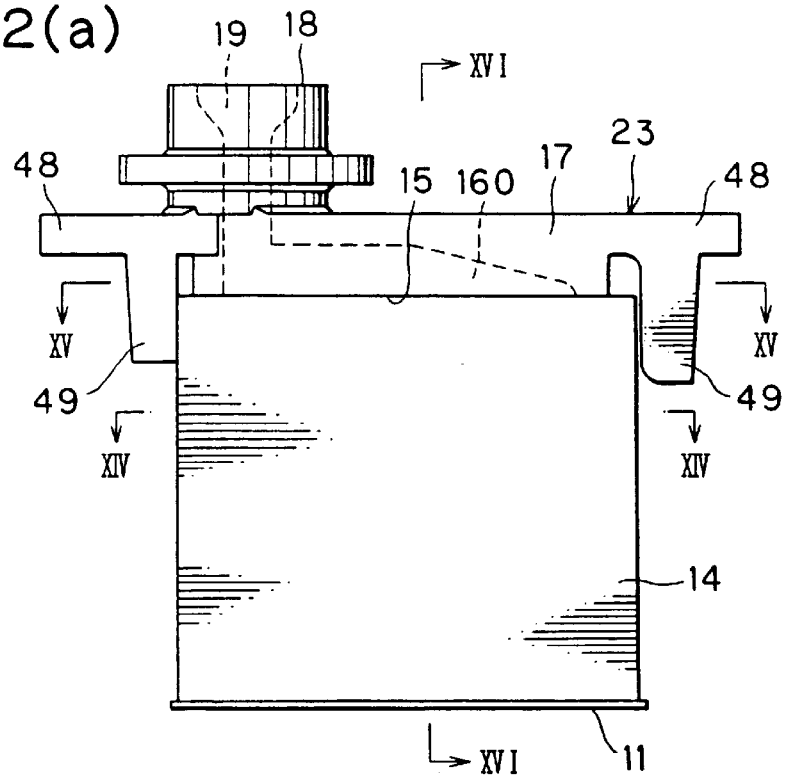
FIG. 12(*a*) is a side view of an ink-jet print head according to a second embodiment of the present invention.
Figure 12B:
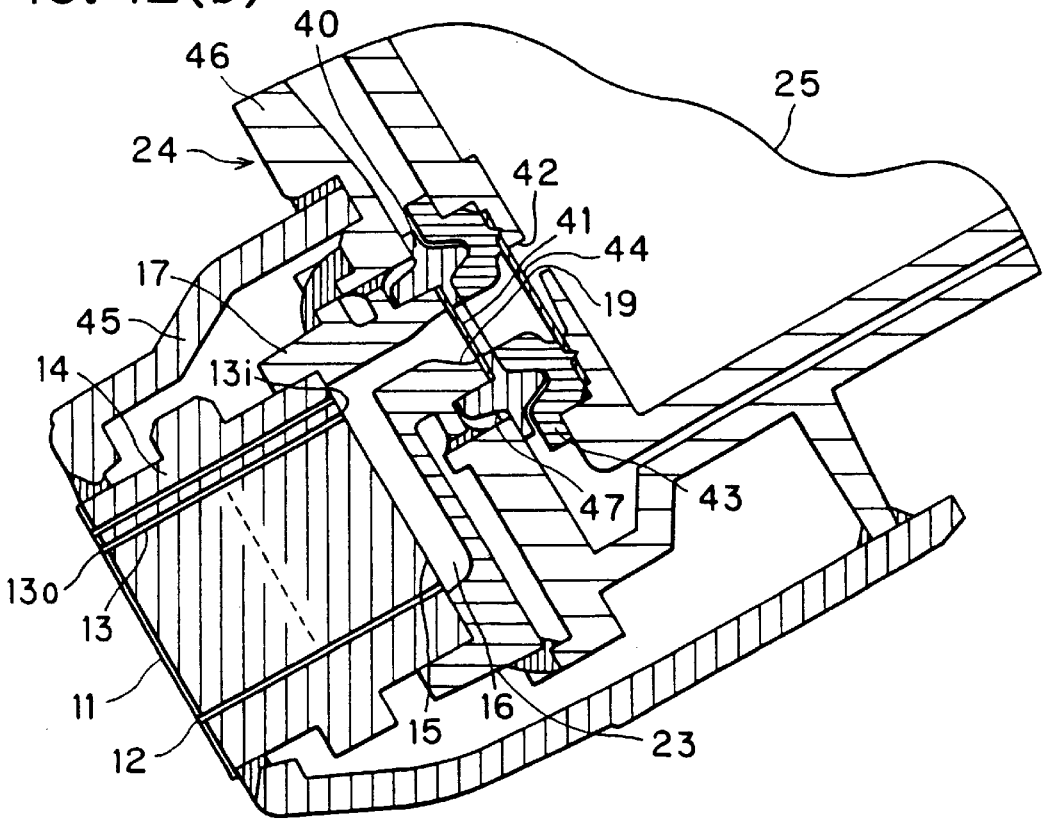

When the manifold 17 is thus bonded to the actuator 14. which is attached with the nozzle plate 11, the ink-jet print head 23 is completely produced as shown in FIG. 12(*a*). In the print head 23, therefore, the inflow ends 13*i* of all the ejection channels 13 in each row are properly located in a corresponding ink supply path 160 as shown in FIG. 15. With this structure, liquid ink can flow from the inflow opening 19 into the ink supply channel 16, down both paths 160 and 160, and is introduced into all the ejection channels 13 in each row.

The thus fabricated ink-jet print head 23 is attached to the carriage wall 46 and mounted in the printing device 21 as shown in FIG. 12(*b*) in the same manner as in the first embodiment.

As described above, according to the present embodiment, as shown in FIG. 16, the upper end surface 71 of the central plate 55, interposed between the rows of ejection channels 13, is positioned closer to the nozzle plate 11 than the upper end surfaces 70 of the base plates 55. Therefore, a gap is formed between the upper end surface 71 of the central plate 55 and the central surface 16, area 60 of the manifold 17. Hence, an ink flow channel 80 is formed in this gap, allowing ink to flow in directions both parallel to and orthogonal to the rows of ejection channels 13.

Any air bubbles B existing in the ink supply paths 160 may possibly stay on the inner walls of the ink supply paths 160 due to buoyancy and other factors. These air bubbles B are indicated by dotted lines in FIG. 16. Even when time elapses and the air bubbles grow, resulting in the condition shown by the air bubbles B indicated by a solid line, the air bubbles B will not obstruct the ink from flowing in the ink flow channel 80. Thus, ink can be introduced properly into all the ejection channels 13.

Even If the air bubbles B continues to accumulate and grow, the ebb and flow of ink resulting from ejection are ensured through the ink flow channel 80. The rate of flow in the ink flow channel 80 does not increase. Accordingly, the amount of negative pressure applied on the outer surface of the growing air bubbles B does not become large. Hence, the air bubbles B will not easily be drawn into the ejection channels 13, and a good quality, of ejection can be maintained. As a result, the purge -operation need not be performed frequently, thereby improving the efficiency of operations.

In general, when desiring to perform printing operation after more than a specified amount of time has elapsed since the last purge operation, the purge operation has to be performed. The specified amount of time is determined based on a period of time estimated to be required by the air bubbles B to grow to a size that will affect ejection. If this period of time is estimated as small, then the purge operation need to be performed frequently, decreasing the amount of ink available for printing. According to the present embodiment, however, the time period, required by the air bubbles to grow to the ejection affecting size, can be increased, thereby increasing the amount of ink available during printing.

It is additionally noted that if the time interval, at which purge operations are performed repeatedly, is short, the number of opportunities to perform a purge operation before printing becomes high. As a result, much time is consumed before a desired printing output is completed. On the other hand, since the purge operation is not performed frequently with the present embodiment, less time is consumed when performing a printing operation. As a result, the user does not have to wait as long. The operability of the ink-jet printing device is enhanced.

Moreover, the internal volume of the ink flow channel 80, established in the actuator 14, is sufficiently small in comparison to the internal volume of the ink supply paths 160 and 160 formed in the manifold 17. Therefore, increase in the overall internal volume of the ink supply channel is slight. As a result, there is only a small increase in the amount of ink which has to be removed by the purge device 35. Accordingly, increase in the load on the maintenance system in the purge device 35 can be suppressed.

As described above, the upper end surface 71 of the central plate 55, interposed between the ejection channel rows 13, is positioned closer to the nozzle plate 11 than the upper end surfaces 70 and 70 of the base plates 53 and 53. Thus, the ink flow channel 80 can be formed with a simple construction.

The ink flow path 80 is in fluid communication with the inflow ends 13*i* of the ejection channels 13 for enabling the liquid ink to flow in a direction along the rows of ejection channels 13. Even if air bubbles accumulate in the ink supply paths 160, the ink flow channel 80 allows ink to flow between the air bubbles B and the ejection channels 13. Accordingly, the ink is not obstructed by the air bubbles B and can flow properly through the ink flow channel 80 and into the ejection channels 13. Accordingly, problems in ejection caused by air bubbles B accumulating in the ink supply paths 160 can be suppressed.

According to the present embodiment, the ink supply channel 16 is divided into the two paths 160 and 160 in correspondence with the two rows of ejection channels 13. For this reason, not only are the ejection channels 13 arranged for maximum effectiveness, but also the construction of the actuator 14 is simplified. Further, forming the ink supply channel 16 into the two paths 160 and 160 enables the ink supply channel 16 to have the small entire volume. This decrease in volume not only aids in decreasing the size of the ink-jet print head 23, but also allows the ink in the ink supply channel 16 to be supplied more smoothly to the ejection channels 13. In particular, formation of the two paths 160 and 160 facilitates the formation of the ink supply channel 16 in the manifold 17, enabling efficient production of the ink-jet print head 23 and further reductions in size to the same.

Figure 17:
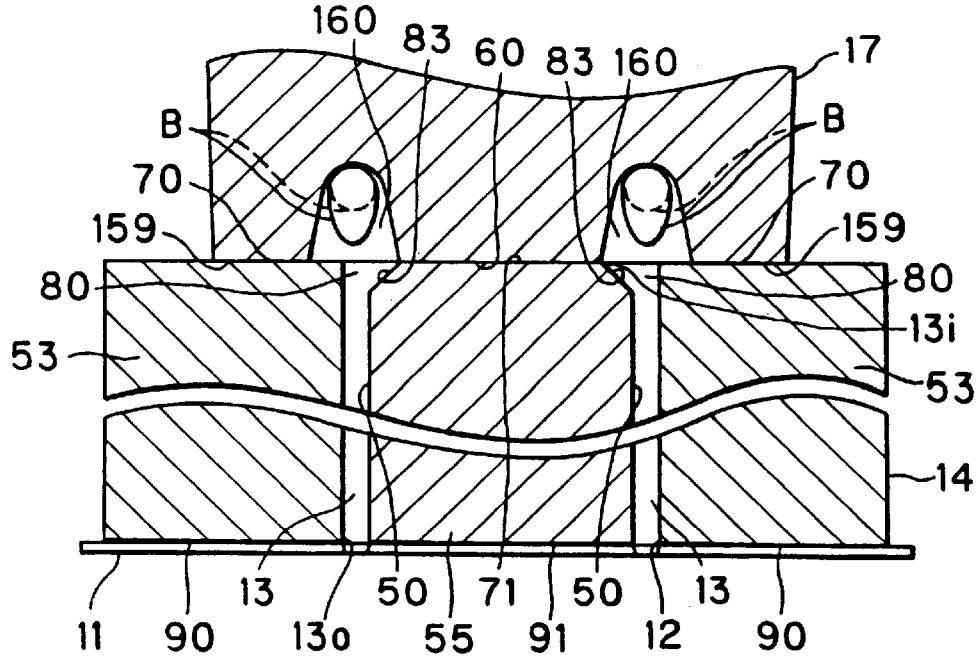
FIG. 17 is a cross-sectional side view corresponding to FIG. 16 in a modification of the second embodiment.

FIG. 17 shows a modification of the present embodiment. According to this modification, the height of the central plate 55 defined between the upper and lower end surfaces 71 and 91 is set equal to the heights of the base plates 53 defined between the upper and lower end surfaces 70 and 90. Accordingly, the end surface 71 of the central plate 55 is located on the same plane as the end surfaces 70 of the base plates 53. Therefore, the end surface 71 is bonded to the central area 60 in the lower surface 15 of the manifold 17 in the same way that the end surfaces 70 of the base plates 53 are bonded to the outside areas 159 of the manifold lower surface 15. With this structure, no gap is formed between the end surface 71 and the central area 60 of the manifold lower surface 15.

At the upper end surface 71 of the central plate 55, a pair of sloped surface areas 83 and 83 are formed on the opposite side surfaces 50 so as to widen the cross-sectional area of the inflow end 13*i* of each ejection channel 13. The sloped surface area 83 widely spreads in a direction toward the inflow end 13*i* of each ejection channel 13. Each sloped surface 83 is formed to extend over the entire length of the corresponding row of ejection channels 13. Two ink flow paths 80 are therefore formed by the sloped surfaces 83 and 83 to extend along the two rows of ejection channels 13. Each ink flow path 80 is formed in the inner side of the corresponding channel row. Each ink flow path 80 connects all the ejection channels 13 In the corresponding channel row.

With this construction, the two ink flow paths 80 can be formed simply by forming the sloped surfaces 83 in fluid communication with the inflow ends 13*i* of the ejection channels 13, that is, simply by beveling the ends of the opposite sides 50 and 50 of the central plate 55. Thus, each ink flow path 80 can be formed with a simple construction. The ink flow path 80 ensures ink flow from the corresponding ink supply path 160 to the ejection channels 13. That is, each ink flow path 80 enables the liquid ink to flow along the corresponding row of ejection channels 13. Accordingly, it becomes possible to suppress the election problems caused by air bubbles B accumulating in the ink supply channel 16.

As described above, according to the ink-jet print head of the second embodiment, the actuator 14 is formed with the plurality of ejection channels 13 in two rows for ejecting liquid ink from nozzles. Each of the ejection channels 13 has an inflow end 13*i* for receiving ink flowing into the ejection channel 13 and an outflow end 13*o* for flowing ink out of the ejection channel. The manifold 17 is joined with the inflow end surface of the actuator 14. The manifold 17 is formed with the ink supply channel 16 for supplying liquid ink from the ink cartridge to each of the ejection channels. The ink supply channel 16 is formed to extend along the rows of the ejection channels 13 to be opened over the inflow ends 13*i* of the ejection channels 13. The ink flow path 80 is formed in fluid communication with the inflow ends 13*i* of the ejection channels 13 at the inflow end side of the actuator 14 to enable the liquid ink to flow in the direction along the rows of ejection channels 13. Thus, an ink flow path is established at the inflow end side of the actuator 14 between the air bubbles and the inflow ends 13*i* of the ejection channels 13. Liquid ink can flow in the direction along the rows of ejection channels. With this configuration, even if air bubbles existing in the ink supply channels accumulate and grow on the upper wall of the ink supply channel 16, the ink is not obstructed-by the air bubbles and can flow normally through the ink flow path 80 and into the ejection channels. Even as the air bubbles continue to grow, the flow of ink is ensured through the ink flow path due to ejection of ink through the nozzles. Hence, the flow rate of the ink in the ink flow path does not increase, and the negative pressure working on the outer surface of the air bubbles can be kept low. Accordingly, the air bubbles will not easily be drawn into the ejection channels 13, and favorable ejection conditions can be maintained for a long time. Therefore, the purge operation need not be executed frequently, improving the quality of operations.

Moreover, the internal volume of the ink flow path 80 established on the actuator 14 is sufficiently small in comparison to the internal volume of the ink supply channel 16 formed in the manifold 17. Therefore, the increase in the overall internal volume of the ink supply channel 16 is slight. As a result, there is only a small increase in the amount of ink which has to be removed by the purge device. Accordingly, the load on the maintenance system in the purge device can be reduced.

Especially, according to the structure of FIG. 16, the ink flow path 80 extends between the rows of ejection channels 13 and extends over the entire length of the respective rows. With this construction, even. if the air bubbles grow, ink can flow between the rows of ejection channels, that is, in a direction approximately orthogonal to the rows. Accordingly, the ink can properly be introduced into all of the ejection channels. Because the ink flow path 80 is established by providing the upper end surface area 71 of the actuator 14, that extends between the rows of ejection channels and that spans the length of the same rows, into a position closer to the nozzle side than the end surface areas 70 on the outer sides of the ejection channel rows. Thus, construction of the ink flow path is simplified.

Especially, according to the modification of FIG. 17, the ink flow path 80 is established by forming the sloped surfaces 83 in the end surface area 71, that extends between the rows of ejection channels 13 and that spans the entire length of the rows of ejection channels, so as to widen the cross-sectional area of each ejection channel 13 toward the inflow end 13*i*. With this construction, ink flow paths can be created simply by forming the sloped surfaces 83 at the inflow ends 13*i* of the ejection channels 13, sloping from the sides of the ejection channels to the end surface. area between the ejection channels.

Especially, according to the present embodiment, the ink supply channel 16 is divided into two ink paths 160, each ink path 160 being opened over a corresponding row of ejection channels 13 and being shared by all the ejection channels 13 in that row. By thus dividing the ink supply channel 16 into the two ink paths 160, the total volume of the ink supply channel 16 can be decreased, thereby allowing the Ink-let print head 23 to be further decreased in size. In addition, ink flowing in the ink supply channel 16 can be more smoothly supplied to each of the rows of ejection channels 13 via the ink paths 160.

Especially, because two rows of ejection channels 13 are formed in the actuator 14, the ejection channels 13 can be arranged most effectively. This construction facilitates production of the actuator 14. Additionally, because the ink supply channel 16 is divided into the two ink paths 160, the ink supply channel 16 can be produced easily in the manifold 17. This enables efficient production of the ink-jet print head 23 and further reductions in size to the same.

While the invention has been described in detail with reference to specific embodiments thereof, it would be apparent to those skilled in the art that various changes and modifications may be made therein without departing from the spirit of the invention.

In the above-described embodiments, the actuator 14 is made from a piezoelectric ceramic element. However, the actuator 14 may be formed from other material. and may be provided with other actuator elements such as thermal elements. That is, the ink-jet print head 23 may be constructed as other types. of print heads such as a thermal head type print head.

The ink-jet print head 23 may not be positioned to face in the slanted downward direction. The ink-jet print head 23 can be positioned such that the nozzle plate 11 is disposed in a vertical plane facing horizontally or in a horizontal plane facing downward. In the former case, the ink-jet print head 23 is preferably positioned so that the inflow opening 19 is positioned above the ink supply channel 16. In either case, approximately the same effects as described above can be achieved.

Figure 18:
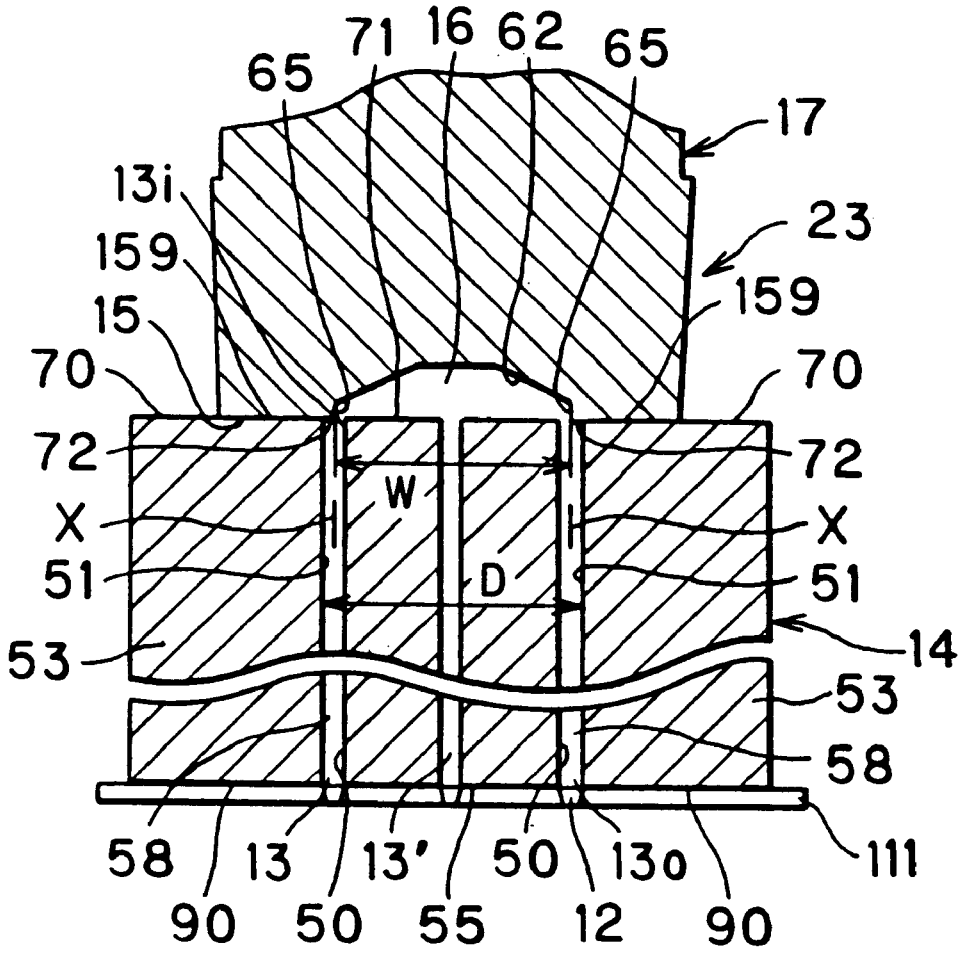
FIG. 18 is a cross-sectional side view corresponding to FIG. 10 in another modification of the first embodiment.

In the first embodiment, only two rows of ejection channels 13 are provided in the actuator 14. However, one or more row of additional ejection channels 13' may be additionally provided in the actuator 14 as shown in FIG. 18. That is, the one or more row of additional ejection channels 13' are provided in the central plate 55 so that the additional ejection channel rows 13' are located between the two rows of ejection channels 13. Also in this case, the width W of the ink supply channel 16 is set less than or equal to the distance D between the outer side inner walls 51 of the two rows of ejection channels 13.

In the second embodiment, the ink flow path 80 may be created in other various methods.

In the second embodiment, the ink supply channel 16 is divided into the two ink supply paths 160. However, the second embodiment can be applied to the case where the ink supply channel 16 has a single ink supply path as in the first embodiment.

In the first embodiment, the ink supply channel 16 has a single ink supply path. However, the first embodiment can be applied to the case where the ink supply channel 16 is divided into the two ink supply paths 160 as in the second embodiment. In this case, the distance W between the outer edges of the ink supply paths 160, that is, the distance between the inner edges 65 of the pair of outer side areas 159 is set equal to or smaller than the distance D between the outer side inner walls 51 and 51 in the two rows of channels 13.

In the modification of the second embodiment, the central plate 55 is beveled at its upper side edges along the entire length of the central plate 55. Accordingly, each sloped surface area 83 is formed to extend along the entire length of the corresponding row of ejection channels 13. However, each upper side edge of the central plate 55 may be beveled only at portions around the respective ejection channels 13. In this case, a plurality of sloped surface areas 83 are formed on each edge around the plurality of channels 13, and therefore are separated from one another. Each sloped surface area 83 serves to increase the cross-sectional area of a corresponding ejection channel 13 in a direction toward its inflow end 13*i*.

What is claimed is:

1. An ink-jet print head comprising:

an actuator formed with a plurality of outer side inner walls, the plurality of outer side inner walls being arranged in two rows, each outer side inner wall on one row being spaced from a corresponding outer side inner wall on the other row at a predetermined distance, each outer side inner wall defining an ejection channel, the actuator having first and second end surfaces opposite to each other, the plurality of outer side inner walls extending between the first and second end surfaces, thereby defining two rows of ejection channels and allowing the ejection channels to be opened at both of the first and second end surfaces, the actuator selectively ejecting liquid ink from the opened ends of the ejection channels at the second end surface; and a manifold connected, at its one surface, to the first end surface of the actuator, the manifold having an ink supply channel opened on its surface connected to the actuator, the ink supply channel extending along the two rows of ejection channels in fluid communication therewith to supply liquid ink to the two rows of ejection channels, a width of the ink supply channel, defined on the surface where the manifold is connected to the actuator, being less than or equal to the predetermined distance.

2. An ink-jet print head as claimed in claim 1, wherein the width of the ink supply channel is approximately the same as a distance between a central point in each ejection channel in one row and a central point in a corresponding ejection channel in the other row.

3. An ink-jet print head as claimed in claim 1, further comprising a nozzle plate formed with two rows of nozzles, the actuator being connected, at its second end surface, to the nozzle plate so that each ejection channel is in fluid communication with a corresponding nozzle in the nozzle plate.

4. An ink-jet print head as claimed in claim 3, wherein the first end surface of the actuator has two outer side areas and a central area positioned between the two outer side areas, the central area being defined between the two rows of ejection channels, the central area being positioned as shifted relative to the two outer side areas in a direction toward the nozzle plate.

5. An ink-jet print head as claimed in claim 4, wherein the actuator includes a central plate positioned between two outer side plates, the central plate having two opposite side surfaces, each opposite side surface defining inner side inner walls defining the ejection channels of a corresponding row, each of the two outer side plates having a first outer side end surface connected to the one surface of the manifold and a second outer side end surface connected to the nozzle plate, the first outer side end surfaces of the two outer side plates serving as the two outer side areas, the central plate having a first central end surface and a second central end surface opposite to each other, the first central end surface of the central plate serving as the central area, the second central end surface being connected to the nozzle plate, the first central end surface confronting the ink supply channel and being shifted relative to the first outer side end surfaces of the two outer side plates in a direction toward the nozzle plate.

6. An ink-jet print head as claimed in claim 1, wherein the actuator is formed with at least one additional row of ejection channels which is located between the two rows of ejection channels and which extends between the first and second end surfaces.

* * * * *